US005677104A

United States Patent [19]

Hirai et al.

[11] Patent Number: 5,677,104

[45] Date of Patent: Oct. 14, 1997

4

[54] IMAGE FORMATION METHOD

[75] Inventors: Hiroyuki Hirai; Hiroshi Hara; Kiyoteru Miyake, all of Kanagawa, Japan

[73] Assignee: Fuji Photo Film Co., Ltd., Kanagawa, Japan

[21] Appl. No.: 579,196

[22] Filed: Dec. 27, 1995

[30] Foreign Application Priority Data

Dec. 27, 1994 [JP] Japan ..... 6-325350
Feb. 10, 1995 [JP] Japan ..... 7-045018

[51] Int. Cl.[6] ..... G03C 8/00

[52] U.S. Cl. ..... 430/203; 430/247; 430/248; 430/249; 430/251; 430/955

[58] Field of Search ..... 430/203, 247, 430/249, 251, 955, 248

[56] References Cited

U.S. PATENT DOCUMENTS

| | | | |
|---|---|---|---|
| 4,624,911 | 11/1986 | Idota et al. | 430/251 |
| 4,711,885 | 12/1987 | Yokoyama et al. | 430/531 |
| 4,766,052 | 8/1988 | Nakamura et al. | 430/203 |
| 4,876,171 | 10/1989 | Hirai | 430/203 |
| 5,135,835 | 8/1992 | Toshiaki et al. . | |

FOREIGN PATENT DOCUMENTS

| | | |
|---|---|---|
| 0491089 | 6/1992 | European Pat. Off. . |
| 62-283335 | 12/1987 | Japan . |

*Primary Examiner*—Thorl Chea

*Attorney, Agent, or Firm*—Sughrue, Mion, Zinn, Macpeak & Seas, PLLC

[57] ABSTRACT

An image formation method is described, which comprises overlaying a silver halide light-sensitive material with a sheet after or during imagewise exposure, the light-sensitive material comprising a support having provided thereon at least a light-sensitive silver halide mainly comprising silver chloride, a hydrophilic binder, a reducing agent and a slightly water-soluble basic metal compound, the sheet comprising a support having provided thereon at least a compound forming a complex with a metal ion constituting said basic metal compound, a physical development nucleus, and a compound represented by the following formula (I) or a compound containing a sulfite ion; and heat-developing the material in the presence of water to form a silver image on at least one of the light-sensitive material and the sheet:

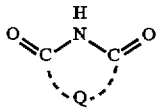

(I)

wherein Q represents an atomic group necessary to form a 5- or 6-membered imide ring.

2 Claims, No Drawings

IMAGE FORMATION METHOD

FIELD OF THE INVENTION

The present invention relates to an image formation method using a silver halide light-sensitive material. Particularly, the present invention relates to an image formation method using a heat developable light-sensitive material, whereby a black-and-white image high in density and low in fog can be obtained for a short period of time.

BACKGROUND OF THE INVENTION

Photographic methods using silver halides are excellent in photographic characteristics such as sensitivity, gradation control and resolving power, as compared with other photographic methods such as electrophotographic methods and diazo photographic methods, and therefore have previously been most widely used.

The heat developable light-sensitive materials are known in the art, and the heat developable light-sensitive materials and processes thereof are described in, for example, *Shashin Kohgaku no Kiso* (*Higinen Shashin*) (The Fundamentals of Photographic Engineering (Nonsilver Photograph)), pages 242 to 255 (1982), Corona Publishing Co. Ltd.

At present, image information is largely shifted from black-and-white images to color images because of a great deal of information and easy expressions. However, black-and-white images are still preferably used in specific fields such as the medical field. Also in the print field, character information is usually used as black-and-white images.

In recent years, systems which can obtain images easily and rabidly have been developed by shifting image formation processing of light-sensitive materials using silver halides from conventional wet processing to instant systems containing developing solutions and further to dry heat development processing by heating also from the viewpoint of environmental protection. Such heat developable black-and-white light-sensitive materials are described in, for example, JP-B-43-4921 (the term "JP-B" as used herein means an "examined Japanese patent publication") and JP-B-43-4924, and commercial products thereof typically include "Dry Silver" supplied from Minnesota Mining and Manufacturing Co. The light-sensitive materials comprise silver halides, organic silver salts and reducing agents. In this system, unused silver halides and organic silver salts remain in the light-sensitive materials. The light-sensitive materials have therefore the disadvantage that the residual silver halides and organic silver salts are allowed to react to cause coloration of white grounds, resulting in loss of contrast, when they are exposed to strong light or stored for a long period of time.

Further, a method for obtaining black color images by dry processing is described in *Research Disclosure* (hereinafter abbreviated as "RD"), No. 17326, pages 49 to 51 (September, 1978). However, this system also has the same disadvantage as described above because of the unfixing type containing silver and silver salts in color images.

In order to overcome this disadvantage, methods for forming black-and-white images are proposed in which, after movable (diffusible) dyes are formed or released in the image-like form by heating, the movable dyes are transferred to dye fixing materials containing dye acceptable materials such as mordants and heat-resistant organic polymers by use of various transfer solvents, thereby improving keeping quality (JP-B-3-78617 and JP-B-3-45820).

However, in these methods, transfer is conducted after heat development, so that the number of steps is increased and the processing time is prolonged.

Further, JP-A-3-260645 (the term "JP-A" as used herein means an "unexamined published Japanese patent application") discloses heat development black-and-white image formation methods in which coupling reaction is utilized, including a method of conducting transfer after development and a method of conducting development and transfer at the same time. However, these methods also take a long period of time and a high temperature for processing because of the absence of a development transfer accelerator.

Furthermore, in order to obtain images having a transmission density of 2 or more which are required for many black-and-white images, by dye transfer methods for a short period of time, it is necessary to reduce the film thickness of the light-sensitive materials, particularly to make the amount of binders as small as possible, and to increase the amount of dye-donating compounds used. This raises the problems of a lowered quality of the films and increased cost. In addition, it has turned out that the use thereof is limited because of a reduction in sharpness due to transfer.

JP-A-62-129848 discloses that heat development can be conducted by use of a small amount of water to form black-and-white images with transferred dye images. However, in order to obtain images having a transmission density of 2 or more which are required for many black-and-white images, by dye transfer methods for a short period of time, it is necessary to reduce the film thickness of the light-sensitive materials, particularly to make the amount of binders as small as possible, and to increase the amount of dye-donating compounds used. This raises the problems of a lowered quality of the films and increased cost. Further, this introduces the problem that the use thereof is limited because of a reduction in sharpness due to transfer. Furthermore, it is difficult to synthesize black dye-donating compounds, and it is also difficult to obtain neutral gray color images by mixing yellow, magenta and cyan dye-donating compounds.

On the other hand, methods for forming silver images by heat development silver salt diffusion transfer methods using silver halide light-sensitive materials are disclosed in JP-A-62-283332, JP-A-63-198050 and JP-A-60-194448. However, these methods are also methods utilizing transferred silver images. It is therefore difficult to obtain images having a transmission density of 2 or more and a high sharpness for a short period of time, and improvements have been required.

SUMMARY OF THE INVENTION

An object of the present invention is to provide an image formation method for obtaining a black-and-white image high in density and excellent in sharpness.

Another object of the present invention is to provide an image formation method in which a silver image is obtained for a short period of time, and in which a light-sensitive material and a transfer sheet excellent in virgin stock storability are used.

A further object of the present invention is to provide an image formation method for obtaining an image stable to light, temperature or humidity.

These and other objects of the present invention have been attained by an image formation method comprising overlaying a silver halide light-sensitive material with a sheet after or during imagewise exposure, said light-sensitive material comprising a support having provided thereon at least a light-sensitive silver halide containing 90 mol % or more of silver chloride, a hydrophilic binder, a reducing agent and a slightly water-soluble basic metal compound, said sheet comprising a support having provided thereon at least a compound forming a complex with a metal ion constituting said basic metal compound (hereinafter referred to as a "complexing agent"), a physical development nucleus and a compound represented by the following formula (I); and heat-developing the material in the presence of water to form a silver image on at least one of the light-sensitive material and the sheet:

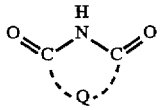

(I)

wherein Q represents an atomic group necessary to form a 5- or 6-membered imide ring.

Furthermore, these and other objects of the present invention have been attained by an image formation method comprising overlaying a silver halide light-sensitive material with a sheet after or during imagewise exposure, said light-sensitive material comprising a support having provided thereon at least a light-sensitive silver halide containing 80 mol % or more of silver chloride, a hydrophilic binder, a reducing agent and a slightly water-soluble basic metal compound, said sheet comprising a support having provided thereon at least a complex-forming compound with a metal ion constituting said basic metal compound, a physical development nucleus and a compound containing a sulfite ion; and heat-developing the material in the presence of water to form a silver image on at least one of the light-sensitive material and the sheet.

DETAILED DESCRIPTION OF THE INVENTION

To a nitrogen atom or a carbon atom constituting Q, a hydrogen atom, an amino group, an alkyl group having 1 to 4 carbon atoms, a halogen atom, a keto oxygen atom or an aryl group may be linked as a branch (substituent).

The compounds having the imide rings represented by formula (I) are dissolvable in an amount of at least 0.1 g, preferably 0.5 g or more, in 100 ml of an aqueous solution of an equimolar amount of sodium hydroxide.

Examples of the compounds having the imide rings represented by formula (I) include uracil, 5-bromouracil, 4-methyluracil, 5-methyluracil, 4-carboxyuracil, 4,5-dimethyluracil, 5-aminouracil, dihydrouracil, 1-ethyl-6-methyluracil, 5-carboxymethylaminouracil, barbituric acid, 5-phenylbarbituric acid, cyanuric acid, urazole, hydantoin, 5,5-dimethylhydantoin, glutarimide, glutaconimide, citrazinic acid, succinimide, 3,4-dimethylsuccinimide and maleimide.

In the present invention, among the compounds having the imide ring represented by formula (I), uracil and derivatives thereof such as 5-bromouracil, 4-methyluracil, 5-methyluracil, 4-carboxyuracil, 4,5-dimethyluracil, 5-aminouracil, dihydrouracil, 1-ethyl-6-methyluracil and 5-carboxymethylaminouracil are particularly preferred.

The amount of the compounds represented by formula (I) contained in the above-described sheet which is a complexing agent-containing sheet (hereinafter referred to as "complexing agent sheets") is 0.01 to 5 g/m$^2$, preferably 0.05 to 2.5 g/m$^2$. This amount is 1/20 to 20 times, preferably 1/10 to 10 times, the amount of silver coated of the light-sensitive materials in molar ratio. The compounds represented by formula (I) may be either added to solvents such as water, methanol, ethanol, acetone and DMF or aqueous alkali solutions, or dispersed as fine solid particles to use as coating solutions.

In the present invention, it is particularly preferred that the compounds are dissolved in aqueous solutions of equimolar amounts of alkalis (bases) such as sodium hydroxide, potassium hydroxide and tetramethylammonium hydroxide.

In the present invention, the complexing agent sheets preferably contain a polymer comprising at least one of a repeating unit represented by the following formula (II) and a repeating unit represented by the following formula (III) as constituents together with the compounds represented by formula (I) or the compounds containing a sulfite ion, whereby not only the density of transferred silver images on the complexing agent sheets, but also that of silver images on the light-sensitive materials are increased. It is utterly unexpected profound effect that the polymers applied to different supports increase even the image density of light-sensitive materials.

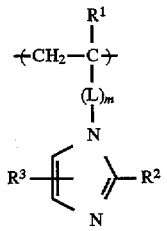

(II)

wherein $R^1$, $R^2$ and $R^3$ each represents a hydrogen atom or an alkyl group having 1 to 6 carbon atoms such as methyl, ethyl, n-propyl, n-butyl, n-amyl or n-hexyl. Hydrogen, methyl and ethyl are particularly preferred.

L represents a divalent binding group having 1 to 20 carbon atoms such as an alkylene group (for example, methylene, ethylene, trimethylene, hexamethylene), a phenylene group (for example, o-phenylene, m-phenylene or p-phenylene), an arylenealkylene group (for example, p-phenylenemethylene, m-phenyleneethylene), —$CO_2$—, —$CO_2$—$R^4$— (wherein $R^4$ represents an alkylene group, a phenylene group or an arylenealkylene group) or —CON($R^1$)—$R^4$— (wherein $R^1$ and $R^4$ have the same meanings as given above; however, $R^1$ and $R^4$ may be the same or different). In particular, m-phenylene, p-phenylene, p-phenylenemethylene, m-phenylenemethylene, —$CO_2$—, —CONH—, —$CO_2$—$CH_2CH_2$—, —$CO_2$—$CH_2CH_2CH_2$—, —CONH$CH_2$—, —CONH$CH_2CH_2$—, and —CONH$CH_2CH_2CH_2$— are preferred.

m is 0 or 1.

Preferred examples of the monomer units represented by formula (II) are shown below:

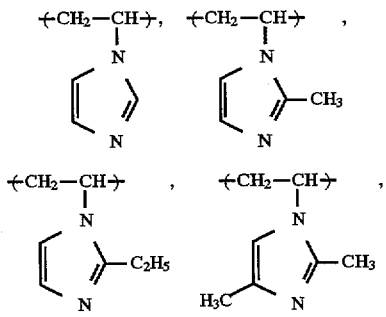

-continued

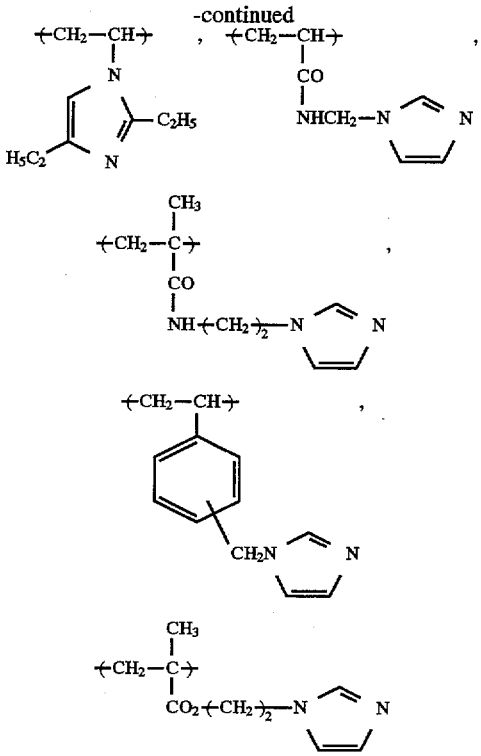

The monomer units represented by formula (III) are described below:

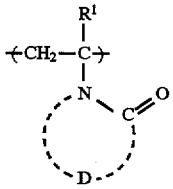

(III)

wherein $R^1$ has the same meaning as given for formula (II), provided that $R^1$ in formula (II) and $R^1$ in formula (III) may be the same or different; and D represents a divalent binding group necessary to form a 5-, 6- or 7-membered ring together with a nitrogen atom and a carbonyl group. The binding group D represents a divalent group comprising a carbon atom (for example, $—CH_2CH_2CH_2—$, $—CH_2CH_2CH_2CH_2—$, $CH_2CH_2CH_2CH_2CH_2—$, $C(=O)—CH_2CH_2—$, $—C(=O)—CH_2CH_2CH_2—$, $—C(=O)—CH=CH—$), a divalent group comprising a carbon atom and a nitrogen atom (for example, $—NHCH_2CH_2—$, $—C(=O)—NHC(CH_3)_2—$, $—C(=O)—NHCH_2CH_2—$), a divalent group comprising a carbon atom and an oxygen atom (for example, $—OCH_2CH_2—$, $—C(=O)—OCH_2CH_2—$, $—C(=O)—OC(CH_3)_2—$) or a divalent group comprising a carbon atom and a sulfur atom (for example, $—SCH_2CH_2—$, $—C(=O)—SCH_2CH_2—$). The divalent group comprising a carbon atom or comprising a carbon atom and a nitrogen atom is particularly preferred.

Preferred examples of the monomer units represented by formula (III) are shown below:

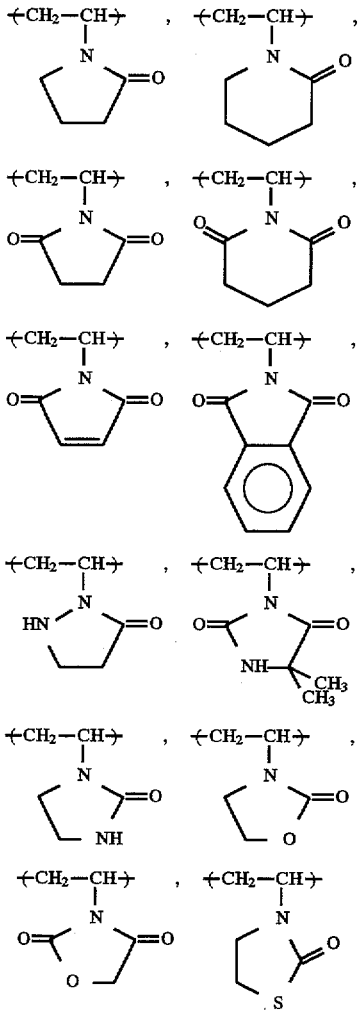

In the present invention, the polymer having the repeating unit represented by formula (II) and/or the repeating unit represented by formula (III) as constituents may be either a homopolymer of the respective repeating units or a copolymer of both the repeating units. In the copolymer, the ratio of both can be arbitrarily selected, and the copolymer may contain two or more kinds of monomer units included in the same general formula. Further, both homopolymers may be used in combination. Furthermore, the copolymer may be a copolymer with any other monomer units. In this case, it is preferred that the monomer units represented by formula (II) or the monomer units represented by formula (III) are contained in an amount of 10 mol % or more, preferably 40 mol % or more, of the total polymers.

Preferred examples of the polymers used in the present invention are shown below:

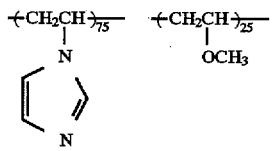

P-1

-continued

P-2

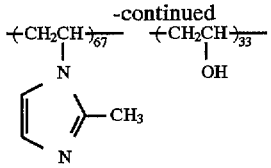

P-3

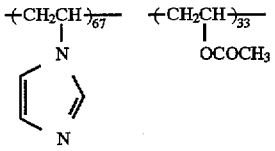

P-4

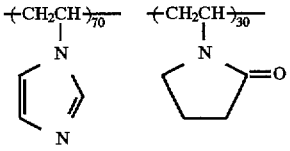

P-5

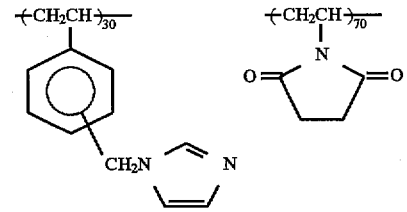

P-6

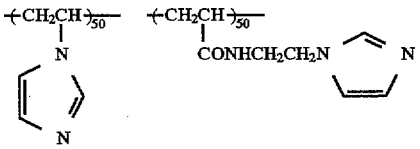

P-7

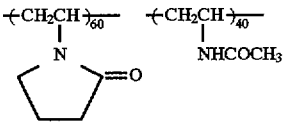

P-8

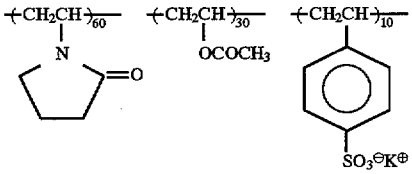

P-9

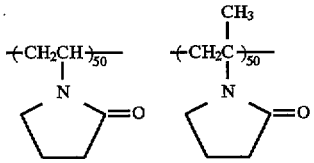

P-10

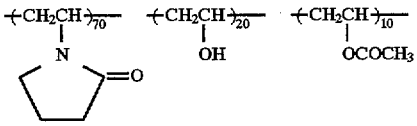

The molecular weight of the polymers used in the present invention can be selected from a wide range, but is preferably $5\times10^3$ to $1\times10^7$. The amount of the polymers used is 0.01 to 10 g, preferably 0.05 to 5 g, per $m^2$ of complexing agent sheet.

The sulfite ion-containing compounds used in the present invention are preferably water-soluble compounds. For example, sodium sulfite, sodium hydrogensulfite, potassium sulfite, ammonium sulfite, and ammonium hydrogensulfite are preferably used. As counter ions to the sulfite ions, alkaline metals such as sodium, potassium and lithium are preferred from the viewpoint of water solubility. However, alkaline earth metals, ammonium and ions of organic compounds such as guanidiums, amidines and tetraalkylammonium hydroxides are also preferably used. Slightly water-soluble compounds may also be used as fine solid dispersions. In order to improve the stability of sulfite ion-containing solutions, alcohols such as methanol and ethanol may be added to the solvent of water.

The amount of sulfite ions contained in the sheets containing compounds forming complexes with metal ions of the slightly water-soluble basic metal compounds is 0.01 to 50 mmol/$m^2$, preferably 0.1 to 30 mmol/$m^2$, and more preferably 1 to 20 mmol/$m^2$. This amount is 1/20 to 20 times, preferably 1/10 to 10 times, and more preferably 1/3 to 3 times, the amount of silver coated of the light-sensitive materials in molar ratio.

Sulfites, particularly sodium sulfite, are known as preservatives for developing solutions and relatively weak solvents for silver halides in the field of photochemistry. This is described in Shinichi Kikuchi, *Photochemistry,* pages 103 to 129 (Kyoritsu Shuppan, 1976) and *The theory of the Photographic Process,* the fourth edition, chapters 6 and 15, edited by T. H. James, (Macmillan, 1977). However, it is utterly unexpected profound effect that addition of the complexing agents decreases Dmin of light-sensitive materials without decreasing Dmax thereof as the present invention. It also has the effect of reducing the residual color due to sensitizing dyes and/or dyes.

The known solvents for silver halides may be used in combination in the complexing agent sheets used in the present invention, if necessary. For example, thiosulfates such as sodium thiosulfate and ammonium thiosulfate, thiocyanates such as potassium thiocyanate and ammonium thiocyanate, thioether compounds such as 1,8-di-3,6-dithiaoctane, 2,2'-thiodiethanol and 6,9-dioxa-3,12-dithiatetradecane-1,14-diol described in JP-B-47-11386, and compounds represented by the following formula described in JP-A-53-144319 can be used:

$$N(R_1)(R_2)—C(=S)—X—R_3$$

wherein X represents a sulfur atom or an oxygen atom; $R_1$ and $R_2$, which are groups linked to the N atom and may be the same or different, each represents an aliphatic group, an aryl group, a heterocyclic ring residue or an amino group; $R_3$ represents an aliphatic group or an aryl group; and $R_1$ and $R_2$, or $R_2$ and $R_3$may combine together to form a 5- or 6-membered heterocyclic ring.

Further, combinations of cyclic imides and nitrogen bases such as derivatives of uracil, barbituric acid succinimide may also be used in combination, and thione compounds and thiourea compounds, particularly cyclic compounds, my also be used in combination.

When the solvents for silver halides are used in combination, the amount thereof is 1/2 or less, preferably 1/5 or less, and more preferably 1/8 or less, that of the sulfite ions in molar ratio.

In the present invention, there are used combinations of the slightly water-soluble basic metal compounds used as base precursors and the compounds (complexing agents) which can undergo complex formation with the metal ions constituting the basic metal compounds through water as a medium disclosed in JP-A-62-129848 and EP-A-210,660.

Preferred examples of the basic metal compounds include oxides, hydroxides and basic carbonates of zinc or aluminum, and zinc oxide, zinc hydroxide and basic zinc carbonate are particularly preferred.

The slightly water-soluble basic metal compounds are dispersed as fine particles in hydrophilic binders to use them, as described in JP-A-59-174830. The mean particle size of the fine particles is 0.001 to 5 μm, and preferably 0.01 to 2 μm. The amount of the fine particles contained in the light-sensitive material is 0.01 to 5 g/m$^2$, and preferably 0.05 to 2 g/m$^2$.

The complexing agents used in the complexing agent sheets in the present invention are known as chelating agents in analytical chemistry and as water softeners in photochemistry. Details thereof are described in A. Ringbom, translated by Nobuyuki Tanaka and Haruko Sugi, *Complex Formation* (Sangyo Tosho), as well as the above-mentioned patent specifications.

The complexing agents used in the present invention are preferably water-soluble compounds, which include, for example, aminopolycarboxylic acids (including salts thereof) such as ethylenediaminetetraacetic acid, nitrilotriacetic acid and diethylenetriaminepentaacetic acid, aminophosphonic acids (including salts thereof) such as aminotris(methylenephosphonic acid) and ethylenediaminetetramethylenephosphonic acid, and pyridinecarboxylic acids (including salts thereof) such as 2-picolinic acid, pyridine-2,6-dicarboxylic acid and 5-ethyl-2-picolinic acid. Of these, pyridinecarboxylic acids and salts thereof are particularly preferred.

In the present invention, it is preferred that the complexing agents are used as salts neutralized with bases. In particular, salts of organic bases such as guanidines, amidines and tetraalkylammonium hydroxides are preferably used. Preferred examples of the complexing agents are described in JP-A-62-129848 and EP-A-210660 described above.

When the complexing agents are added to the complexing agent sheets, the amount thereof is 0.01 to 10 g/m$^2$, and preferably 0.05 to 5 g/m$^2$.

In the present invention, the physical development nuclei are added to the complexing agent sheets. The physical development nuclei reduce diffused movable silver salts to silver, thus fixing silver to fixing layers.

As the physical development nuclei, all the physical development nuclei previously known can be used. Examples thereof include heavy metals such as zinc, mercury, lead, cadmium, iron, chromium, nickel, tin, cobalt and copper, noble metals such as palladium, platinum, silver and gold, and sulfides, selenides and tellurides of these various metals. These physical development nucleus compounds are obtained by reducing the corresponding metal ions to produce metal colloidal dispersions, or by mixing metal ion solutions with solutions of soluble sulfides, selenides or tellurides to produce colloidal dispersions of water-insoluble metal sulfides, metal selenides or metal tellurides.

These physical development nuclei are added to the complexing agent sheets usually in an amount of $10^{-6}$ to $10^{-1}$ g/m$^2$, and preferably in an amount of $10^{-5}$ to $10^{-2}$ g/m$^2$.

The physical development nuclei separately prepared can also be added to coating solutions. However, for example, silver nitrate and sodium sulfide, or chloroauric acid and a reducing agent may react with each other in a coating solution containing a hydrophilic binder to produce the physical development nuclei.

The heat developable light-sensitive material used in the present invention basically have light-sensitive silver halides, hydrophilic binders, reducing agents and slightly water-soluble basic metal compounds on supports, and can further contain organic metal salt oxidizing agents, dye-donating compounds, if necessary.

In many cases, these components are added to the same layer. However, they can be separately added to different layers, as long as they are in a reactive state. The reducing agents are contained in the heat developable light-sensitive materials. However, they may be supplied from the outside, for example, by diffusion from the complexing agent sheets. Further, the light-sensitive layer (silver halide emulsion layer) may be divided into two or more layers as needed.

The light-sensitive materials may be provided with various non-light-sensitive layers such as protective layers, undercoat layers, intermediate layers, filter layers and antihalation layers, between the above-mentioned silver halide emulsion layers and as the uppermost and lowermost layers, and can be provided with various supplementary layers such as back layers on the side opposite to each of the supports. Specifically, the light-.sensitive materials can be provided with undercoat layers as described in U.S. Pat. No. 5,051,335, intermediate layers containing reducing agents or DIR compounds as described in JP-A-1-120553, JP-A-5-34884 and JP-A-2-64634, intermediate layers containing electron transfer agents as described in U.S. Pat. Nos. 5,017,454 and 5,139,919 and JP-A-2-235044, protective layers containing reducing agents as described in JP-A-4-249245, or combined layers thereof.

When the support is polyethylene-laminated paper containing a white pigment such as titanium oxide, it is preferred that the back layer is designed to have an antistatic function and a surface resistivity of $10^{12}$ Ω.cm or less.

Silver halide emulsions which can be used in the present invention are preferably silver chloride, silver iodochloride, silver chlorobromide and silver iodochlorobromide. If the compound containing a sulfite ion is used, the content of silver chloride is preferably 80 mol % or more, more preferably 90 mol % or more, and most preferably 95 mol % or more. If the compound represented by formula (I) is used, the content of silver chloride is preferably 90 mol % or more, more preferably 95 mol % or more. The content of silver iodide is preferably 2 mol % or less, more preferably 1 mol % or less, and most preferably 0.5 mol % or less.

The silver halide emulsions used in the present invention may be either surface latent image type emulsions or internal latent image type emulsions. The internal latent image type emulsions are used as direct reversal emulsions in combination with nucleating agents or light fogging. Further, they may be so-called core/shell emulsions in which the insides of grains are different from the surfaces thereof in the phase, and silver halides different in composition may be joined by epitaxial junction. Furthermore, the silver halide emulsions may be either monodisperse emulsions or polydisperse emulsions, and methods are preferably used in which monodisperse emulsions are mixed to adjust gradation as described in JP-A-1-167743 and JP-A-4-223463. The grain size is preferably 0.01 to 2 μm, and more preferably 0.1 to 1.5 μm. The silver halide grains may be any of a regular crystal form such as a cubic, an octahedral or a tetradecahedral form, an irregular crystal form such as a spherical form or a plate (tabular) form high in aspect ratio, a form having a crystal defect such as a twin plane, and a combined form thereof.

Specifically, there can be used any of silver halide emulsions prepared by methods described in U.S. Pat. No. 4,500,626, column 50, U.S. Pat. No. 4,628,021, *Research Disclosure* (hereinafter abbreviated as "RD"), No. 17029 (1978), ibid., No. 17643, pages 22 and 23 (December, 1978), ibid., No. 18716, page 648 (November, 1979), ibid., No. 307105, pages 863– 865 (November, 1989), JP-A-62-253159, JP-A-64-13546, JP-A-2-236546, JP-A-3-110555, P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

In particular, in high silver chloride emulsions used in the present invention, silver halide grains having silver bromide-localized phases in the insides and/or on surfaces thereof in a layer form or in a non-layer form can also be used. For the halogen composition of the localized phases, the silver bromide content is preferably at least 20 mol %, and more preferably above 30 mol %. The silver bromide content of the silver bromide-localized phases is measured by, for example, X-ray diffraction. For example, application of X-ray diffraction to silver halide grains is described in C. R. Berry and S. J. Marino, *Photographic Science and Technology,* vol. 2, page 149 (1955) and ibid., vol. 4, page 22 (1957). The silver bromide-localized phases can exist inside the grains, on edges and corners of surfaces of the grains, and on the surfaces thereof. Preferred examples thereof include localized phases formed on the corner portions of the grains by epitaxial junction.

The silver halide grains can be used, selected from normal crystals free from twin planes, a single twin containing one twin plane, parallel multiple twins containing two or more parallel twin planes, non-parallel multiple twins containing two or more non-parallel twin planes, spherical grains, potato-like grains, tabular grains having a high aspect ratio and combined systems thereof according to their purpose. The form of twin grains is described in *Shashin Kohgaku no Kiso* (*Higinen Shashin*) (The Fundamentals of Photographic Engineering (Nonsilver Photograph)), page 163, edited by Nippon Shashin Gakkai, Corona Publishing Co. Ltd.

In the case of normal crystals, the grains having the cubic form comprising a (100) face, the octahedral form comprising a (111) face, and the dodecahedral form comprising a (110) face can be used. The dodecahedral grains are described in JP-B-55-42737 and JP-A-60-222842, and further reported in *Journal of Imaging Science,* vol. 30, page 247 (1986). Grains having (h11) faces, (hh1) faces, (hk0) faces and (hk1) faces can also be used according to their purpose. Tetradecahedral grains having (111) and (100) faces and grains having (111) and (110) faces can also be utilized. Polyhedral grains such as octatriacontahedral grains, deformed rhombic tetracosahedral grains, hexatetracontahedral grains and octahexacontahedral grains can also be used as needed.

The tabular grains having a high aspect ratio can also be preferably used. The tabular grains of high silver chloride emulsions having (111) faces are described in U.S. Pat. Nos. 4,399,215, 4,400,463 and 5,217,858, and JP-A-2-32, and the tabular grains of high silver chloride emulsions having (100) faces are described in U.S. Pat. Nos. 4,946,772, 5,275,930 and 5,264,337, JP-A-6-59360, JP-A-6-308648, and EP-A-534,395. Such grains having a high aspect ratio are larger in surface area than normal crystals having the same volume, so that the amount of sensitizing dyes adsorbed can be increased. This is advantageous in terms of color sensitization sensitivity. Further, this is advantageous in terms of covering power, so that a small amount of silver can achieve high Dmax. The grains have the feature that the developing activity is high because of their high specific surface area.

The silver halide grains may have any mean grain size, ranging from fine grains having a mean grain size of 0.05 μm or less to large-sized grains having a diameter of a projected area exceeding 10 μm. The mean grain size is preferably 0.1 to 2 μm, and more preferably 0.1 to 0.9 μm.

The monodisperse emulsions having a narrow grain size distribution may be used. The monodisperse emulsions are, for example, silver halide emulsions having such a grain size distribution that 80% or more of the weight or the number of the total grains fall within the range of ±30% of a mean grain size. Further, the monodisperse emulsions may have a coefficient of variation of 20% or less, particularly 15% or less.

The polydisperse emulsions having a wide grain size distribution may also be used.

Further, for adjusting gradation, two or more kinds of monodisperse silver halide emulsions may be used in combination which have a substantially identical color sensitivity and are different in grain size, as described in JP-A-1-167743 and JP-A-4-223463. The two or more kinds of emulsions may be added to the same layer or separately added to different layers. Combinations of two or more kinds of polydisperse silver halide emulsions or combinations of monodisperse emulsions and polydisperse emulsion can also be used.

In the course of preparation of the silver halide emulsions in the present invention, salt removal for removing excess salts is preferably conducted. Water washing with noodle may be used which is conducted by gelation of gelatin, and precipitation (flocculation) may also be used in which multiply charged anionic inorganic salts (for example, sodium sulfate), anionic surfactants, anionic polymers (for example, sodium polystyrenesulfonate) or gelatin derivatives (for example, aliphatic acylated gelatin, aromatic acylated gelatin and aromatic carbamoylated gelatin) are utilized. Ultrafilters shown in U.S. Pat. No. 4,758,505, JP-A-62-113137, JP-B-59-43727 and U.S. Pat. No. 4,334,012 may also be used, and spontaneous precipitation and centrifugation may also be used. Usually, precipitation is preferably used.

For various purposes, the light-sensitive silver halide emulsions used in the present invention may contain heavy metals such as iridium, rhodium, platinum, cadmium, zinc, thallium, lead, iron and osmium. These metals may be used alone or in combination. The amount added is generally about $10^{-9}$ to $10^{-3}$ mol per mol of silver halide, although it depends on the purpose of use. They may be uniformly added to grains or localized in the insides or on surfaces thereof. Specifically, emulsions described in JP-A-2-236542, JP-A-1-116637 and JP-A-5-181246 are preferably used.

In the grain formation stage of the light-sensitive silver halide emulsions used in the present invention, rhodanides, ammonia, 4-substituted thioether compounds, organic thioether derivatives described in JP-B-47-11386 or sulfur-containing compounds described in JP-A-53-144319 can be used as solvents for silver halides.

The preparation methods may be any of acidic, neutral and ammonia processes. A soluble silver salt and a soluble halogen salt may be reacted with each other by using any of a single jet process, a double jet process and a combination thereof. A so-called reverse mixing process in which grains are formed in the presence of excess silver ions can also be used. As a type of double jet process, there can also be used a process for maintaining constant the pAg in a liquid phase in which a silver halide is formed, namely a so-called controlled double jet process. According to this process, silver halide emulsions in which the crystal system is regular and the grain size is nearly uniform.

In the preparation of the silver halide emulsions, it is preferred to adjust the pAg and the pH during formation of the grains. The adjustment of the pAg and the pH are described in *Photographic Science and Engineering,* vol. 6, pages 159 to 165 (1962), *Journal of Photographic Science,* vol. 12, pages 242 to 251 (1964), U.S. Pat. No. 3,655,394 and British Patent 1,413,748.

As protective colloids used in the preparation of the emulsions in the present invention, gelatin is advantageously used, but other hydrophilic colloids can also be used. The hydrophilic colloids can be used alone or in combination with gelatin. Examples of the hydrophilic colloids which can be preferably used include proteins such as gelatin derivatives, graft polymers of gelatin with other polymers, albumin and casein; cellulose derivatives such as hydroxyethyl cellulose and cellulose sulfates; sodium alginate; starch derivatives; polysaccharides; carrageenan; and synthetic hydrophilic polymers such as homopolymers and copolymers of polyvinyl alcohol, modified alkyl polyvinyl alcohols, poly-N-vinylpyrrolidone, polyacrylic acid, polymethacrylic acid, polyacrylamide, polyvinylimidazole and polyvinylpyrazole. Thioether polymers described in U.S. Pat. No. 3,615,624 can also be preferably used.

As gelatin, gelatin derivatives such as acid-treated gelatin, delimed gelatin and phthalated gelatin, and low molecular weight gelatin, besides lime-treated gelatin, can be used. Further, gelatin oxidized with an oxidizing agent such as hydrogen peroxide and enzyme-treated gelatin can also be used. Hydrolyzed or enzymatically decomposed products of gelatin can also be used.

Examples of the solvents for silver halides include thiocyanates described in U.S. Pat. Nos. 2,222,264, 2,448,534 and 3,320,069, thioether compounds described in U.S. Pat. Nos. 3,271,157, 3,574,628, 3,704,130, 4,297,439 and 4,276,347, thione compounds described in JP-A-53-144319, JP-A-53-82408 and JP-A-55-77737, imidazole compounds described in JP-A-54-100717, benzimidazole compounds described in JP-B-60-54662 and amine compounds described in JP-A-54-100717. Ammonia can also be used in combination with the solvents for silver halides as long as it does not exert an adverse effect. Nitrogen-containing compounds as described in, e.g., JP-B-46-7781, JP-A-60-222842, and JP-A-60-122935 can be added in the formation stage of the silver halide grains. Details of examples of the solvents for silver halides are described in JP-A-62-215272, pages 12 to 18.

In the course of preparation or physical ripening of the silver halide grains, metal salts (including complex salts) may be allowed to coexist. Examples of the metal salts include salts or complex salts of noble metals or heavy metals such as cadmium, zinc, lead, thallium, iridium, platinum, palladium, osmium, rhodium, chromium, ruthenium and rhenium. These compounds may be used alone or in combination. The amount to be added is about $10^{-9}$ to $10^{-3}$ mol per mol of silver halide. As complex ions and coordination compounds, bromine ions, chlorine ions, cyanogen ions, nitrosyl ions, thionitrosyl ions, water, ammonia and combinations thereof are preferably used. For example, yellow prussiate, $K_2IrCl_6$, $K_3IrCl_6$, $(NH_4)_2RhCl_5(H_2O)$, $K_2RuCl_5(NO)$, and $K_3Cr(CN)_6$ are preferably used. The amount to be added is about $10^{-9}$ to $10^{-2}$ mol per mol of silver halide, although it depends on the purpose of use. They may be uniformly incorporated into the silver halide grains, localized in the insides or on the surfaces of the grains, in the silver bromide-localized phases or in the high silver halide grain bases. These compounds are added by mixing solutions of the metal salts with aqueous solutions of halides in formation of the grains, adding fine grains of the silver halide emulsions doped with the metal ions, or directly adding solutions of the metal salts during or after formation of the grains. In order to increase the sensitivity and the density at high illumination exposure, complex metal salts having cyanogen ions such as iridium and yellow prussiate as ligands, lead chloride, cadmium chloride and zinc chloride can be preferably used. When spectral sensitization is conducted in the red or infrared region, complex metal salts having cyanogen ions such as yellow prussiate as ligands, lead chloride, cadmium chloride and zinc chloride are preferably used. For hard gradation enhancement, rhodium salts, ruthenium salts and chromium salts are preferably used.

The rate of addition, the amount or the concentration of silver salt solutions (for example, an aqueous solution of $AgNO_3$) and halogen compound solutions (for example, an aqueous solution of KBr) added in formation of the silver halide grains may be increased to speed up the formation of the grains. Methods for thus rapidly forming the silver halide grains are described in British Patent 1,335,925, U.S. Pat. Nos. 3,672,900, 3,650,757 and 4,242,445, JP-A-55-142329, JP-A-55-158124, JP-A-58-113927, JP-A-58-113928, JP-A-58-111934 and JP-A-58-111936.

Further, the reaction solutions may be stirred by any known methods. The temperature and the pH of the reaction solutions during formation of the silver halide grains may be arbitrarily established depending on the purpose. The pH preferably ranges from 2.7 to 7.0, and more preferably from 2.5 to 6.0. Halogen may be substituted with halogen forming slightly soluble silver halide grains. This halogen conversion process is described in *Die Grundlagen der Photographischen Prozesse mit Silverhalogeniden,* pages 662 to 669, and *The theory of Photographic Process,* the fourth edition, pages 97 and 98. In this process, halogen may be added either in the form of a solution of a soluble halogen compound or in the form of fine silver halide grains.

In the present invention, the silver halide emulsions can be used as such, without chemical sensitization, but usually chemical sensitization. With respect to chemical sensitization used in the present invention, chalcogen sensitization such as sulfur sensitization, selenium sensitization and tellurium sensitization; noble metal sensitization using gold, platinum or palladium; and reduction sensitization can be used alone or in combination (for example, JP-A-3-110555, JP-A-5-241267). Such chemical sensitization can be conducted in the presence of nitrogen-containing heterocyclic compounds (JP-A-62-253159). Further, antifoggants given later can be added after termination of chemical sensitization. Specifically, methods described in JP-A-5-45833 and JP-A-62-40446 can be used.

The pH on chemical sensitization is preferably 5.3 to 10.5, and more preferably 5.5 to 8.5, and the pAg is preferably 6.0 to 10.5, and more preferably 6.8 to 9.0.

The coated amount of the light-sensitive silver halide emulsions used in the present invention is preferably 1 $mg/m^2$ to 10 $g/m^2$ in terms of silver.

As sulfur sensitizers, unstable sulfur compounds are used. Examples of the sulfur compounds include known sulfur compounds such as thiosulfates (for example, hypo ), thiourea derivatives (for example, diphenylthiourea, triethylthiourea, allylthiourea), allyl isothiocyanate, cystine, p-toluenethiosulfonates, rhodanine derivatives and mercapto compounds. The sulfur sensitizers may be added in an amount sufficient to effectively enhancing the sensitivity of the emulsions, and preferably used within the range of $10^{-9}$ to $10^{-1}$ mol per mol of silver halide as a guide, although the suitable amount thereof varies in balance with the pH, the temperature and other sensitizers, and depending on various conditions such as the size of the silver halide grains.

In selenium sensitization, known unstable selenium compounds are used. Examples of the selenium compounds include colloidal metallic selenium, selenourea derivatives (for example, N,N-dimethylselenourea, N,N-diethylselenourea), selenoketones, selenoamides, aliphatic isoselenocyanates (for example, allyl isoselenocyanate), selenocarboxylic acids and esters thereof, selenophoshpates and selenides such as diethyl selenide and diethyl diselenide. The Selenium sensitizers are preferably used within the range of $10^{-10}$ to $10^{-1}$ mol per mol of silver halide as a guide, although the amount varies depending on various conditions as is the case with the sulfur sensitizers.

In the present invention, noble metal sensitization can also be employed, in addition to chalcogen sensitization. First, in gold sensitization, the valence of gold may be either +1 or +3, and various kinds of gold compounds are used. Typical examples thereof include chloroaurates such as potassium chloroaurate, auric trichloride, potassium aurothiocyanate, potassium iodoaurate, tetraauric acid, ammonium aurothiocyanate, pyridyltrichlorogold, gold sulfide, gold selenide and gold telluride.

The gold sensitizers are preferably used within the range of $10^{-10}$ to $10^{-1}$ mol per mol of silver halide as a guide, although the amount varies depending on various conditions.

The gold sensitizers may be added simultaneously with sulfur sensitization, selenium sensitization or tellurium sensitization, or during, before or after sulfur sensitization, selenium sensitization or tellurium sensitization. It is also possible to use the gold sensitizers alone.

There is no particular limitation on the pAg and the pH of the emulsions which are subjected to sulfur sensitization, selenium sensitization, tellurium sensitization or gold sensitization in the present invention. However, the pAg is preferably within the range of 5 to 11, and more preferably within the range of 6.8 to 9.0, and the pH is preferably within the range of 3 to 10, and more preferably within the range of 5.5to8.5.

In the present invention, noble metals other than gold can also be used as chemical sensitizes. The noble metals other than gold include, for example, salts of metals such as platinum, palladium, iridium and rhodium, and complex salts thereof.

In the present invention, reduction sensitization can be further employed. As reduction sensitizers used in the present invention, there are known ascorbic acid, stannous salts, amines, polyamines, hydrazine derivatives, formamidinesulfinic acids, silane compounds and borane compounds. In the present invention, one selected from these known compounds can be used, or two or more of them can also be used in combination. Preferred examples of the reduction sensitizers include stannous chloride, thiourea dioxide, dimethylamine borane, L-ascorbic acid and aminoiminomethane-sulfinic acid. The amount of the reduction sensitizers depends on emulsion conditions, and therefore must be selected. However, it is suitably within the range of $10^{-9}$ to $10^{-2}$ mol per mol of silver halide.

Besides addition of the above-mentioned reduction sensitizers, growth or ripening in an atmosphere of a low pAg of 1 to 7 which is called silver ripening, growth or ripening in an atmosphere of a high pH of 8 to 11 which is called high pH ripening, or reduction sensitization by passing a hydrogen gas or by use of nascent hydrogen produced by electrolysis can also be selected. Further, two or more of them can be used in combination.

This reduction sensitization can be used alone, but can also be used in combination with the above-mentioned chalcogen Sensitization or noble metal sensitization.

In order to give the color sensitivities of green, red and infrared sensitivities to the light-sensitive silver halide emulsions used in the present invention, the light-sensitive silver halide emulsions are spectrally sensitized with methine dyes or the nucleus thereof. Further, spectral sensitization of a blue region may be applied to blue-sensitive emulsions as needed.

The dyes used include cyanine dyes, merocyanine dyes, complex cyanine dyes, complex merocyanine dyes, holopolarcyanine dyes, hemicyanine dyes, styryl dyes and hemioxanol dyes. Dyes belonging to the cyanine dyes, the merocyanine dyes and the complex merocyanine dyes are particularly useful. Any nuclei usually utilized in cyanine dyes as basic heterocyclic ring nuclei can be applied to these dyes. That is, there can be applied pyrroline, oxazoline, thiazoline, pyrrole, oxazole, thiazole; selenazole, imidazole, tetrazole and pyridine nuclei; nuclei in which alicyclic hydrocarbon rings are fused together with these nuclei; and benzoindolenine, indole, benzoxazole, naphthoxazole, benzothiazole, naphthothiazole, benzoselenazole, benzimidazole and quinoline nuclei. These nuclei may be substituted on carbon atoms.

To the merocyanine dyes or the complex merocyanine dyes, 5- and 6-membered heterocyclic ring nuclei such as pyrazoline-5-one, thiohydantoin, 2-thioxazolidine-2,4-dione, thiazolidine-2,4-dione, rhodanine and thiobarubituric acid nuclei can be applied as nuclei having the ketomethylene structure.

Examples thereof include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for wavelength adjustment in supersensitization and spectral sensitization.

The emulsions may contain dyes having no spectral sensitization action themselves or compounds which do not substantially absorb visible light, but exhibit supersensitization, in combination with the sensitizing dyes (for example, ones described in U.S. Pat. No. 3,615,613, JP-A-59-192242, JP-A-59-191032, JP-A-63-23145). In particular, the compounds described in JP-A-59-191032 and JP-A-59-192242 are preferably used, when the sensitizing dyes having the spectral sensitization sensitivity from the red region to the infrared region are used.

The sensitizing dyes may be added in any stage of the emulsion preparation. Most normally, they are added during a period from completion of chemical sensitization up to before coating, but they can be added simultaneously with addition of the chemical sensitizers to conduct spectral sensitization and chemical sensitization at the same time as described in U.S. Pat. Nos. 3,628,969 and 4,225,666, or they can be added prior to chemical sensitization as described in JP-A-58-113928. Further, they can be added before completion of precipitation formation of the silver halide grains to initiate spectral sensitization. Furthermore, it is also possible to add these compounds in parts, namely to add a part thereof prior to chemical sensitization and the residue after chemical sensitization, as taught in U.S. Pat. No. 4,225,666, and they may be added at any time during formation of the silver halide grains, including methods described in U.S. Pat. No. 4,183,756. The sensitizing agents can be added in an amount of about $9\times10^{-9}$ to about $9\times10^{-3}$ mol per mol of silver halide.

These sensitizing dyes and supersensitizers may be added as solutions in hydrophilic organic solvents such as methanol, aqueous solutions thereof (in some cases, they may be basic or acidic to enhance the solubility), dispersions in gelatin or solutions thereof in surfactants.

In order to enhance adsorption of the sensitizing dyes, soluble Ca compounds, soluble Br compounds, soluble I compounds, soluble Cl compounds or soluble SCN compounds may be added before, after or during addition of the sensitizing dyes. These compounds may be used in combination. $CaCl_2$, KI, KCl, KBr and KSCN are preferably used. Further, they may be fine grains of silver bromide, silver chlorobromide, silver iodobromide, silver iodide and silver rhodanide emulsions.

There is no particular limitation on other additives added to the light-sensitive materials to which the emulsions are applied in the present invention. For example, reference can be made to the descriptions of *Research Disclosure,* vol. 176, item 17643 (RD-17643), ibid., vol. 187, item 18716 (RD-18716), ibid., vol. 307, item 307105 (RD-307105).

As to additives used in such stages and known light-sensitive additives available in the light-sensitive material and the complexing agent sheets used in the present invention, portions of RD-17643, RD-18716 and RD-307105 are listed in which the various additives are described.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 648, RC | p. 868 |
| 5. Antifoggant, Stabilizer | pp. 24–25 | p. 649, RC | pp. 868–870 |
| 6. Light Absorbent, Filter Dye, Ultraviolet Absorbent | pp. 25–26 | p. 649, RC to p. 650, left column (LC) | p. 873 |
| 7. Stain Inhibitor | p. 25, RC | p. 650, LC to RC | |
| 8. Dye Image Stabilizer | p. 25 | p. 650, LC | p. 872 |
| 9. Hardening Agent | p. 26 | p. 651, LC | pp. 874–875 |
| 10. Binder | p. 26 | " | pp. 873–874 |
| 11. Plasticizer, Lubricant | p. 27 | p.650, RC | p. 876 |
| 12. Coating Aid, Surface Active Agent | pp. 26–27 | " | p. 875–876 |
| 13. Antistatic Agent | p. 27 | " | pp. 876–877 |
| 14. Matting Agent | | | pp. 878–879 |

Of the above-mentioned additives, the antifoggants and stabilizers which can be preferably used include azoles (for example, benzothiazolium salts, nitroimidazoles, nitrobenzimidazoles, chlorobenzimidazoles, bromobenzimidazoles, nitroindazoles, benzotriazoles, aminotriazoles); mercapto compounds (for example, mercaptothiazoles, mercaptobenzothiazoles, mercaptobenzimidazoles, mercaptothiadiazoles, mercaptotetrazoles (particularly 1-phenyl-5-mercaptotetrazole and derivatives thereof), mercaptopyrimidines, mercaptotriazines); thioketo compounds such as oxazolinethione; azaindene compounds (for example, triazaindenes, tetraazaindenes (particularly, 4-hydroxy-6-methyl(1,3,3a,7)-tetrazaindenes), pentaazaindenes); benzenethiosulfones; benzenesulfinic acid; and benzenesulfonic acid amides.

As the binders for the layers constituting the heat developable light-sensitive materials and the complexing agent sheets, hydrophilic binders are preferably used. Examples thereof include binders described in *Research Disclosures* stated above and JP-A-64-13546, pages 71 to 75. Specifically, transparent or translucent hydrophilic binders are preferred, and examples thereof include natural compounds such as proteins (for example, gelatin, gelatin derivatives), polysaccharides (for example, cellulose derivatives, agar, starch, gum arabic, dextran, pullulan, furcellaran, carageenan described in EP-A-443,529, low cast bean gum, xanthan gum and pectin) and polysaccharides described in JP-A-1-221736; and synthetic polymers such as polyvinyl alcohol, modified alkyl polyvinyl alcohols described in JP-A-7-219113, polyvinylpyrrolidone and polyacrylamide. Further, there can also be used high water-absorptive polymers described in U.S. Pat. No. 4,960,681 and JP-A-62-245260, namely homopolymers of vinyl monomers having —COOM or —$SO_3M$ (wherein M represents a hydrogen atom or an alkali metal), or copolymers of these vinyl monomers with each other or with other monomers (for example, sodium methacrylate, ammonium methacrylate and Sumikagel L5-H manufactured by Sumitomo Chemical Co, Ltd.). These binders can be used in combination. In particular, combinations of gelatin and the above-mentioned binders are preferred. Gelatin is selected from lime-treated gelatin, acid-treated gelatin and so-called delimed gelatin reduced in content of calcium, depending on various purposes, and they are also preferably used in combination.

When the system of supplying a trace amount of water to conduct heat development is employed, use of the above-mentioned high water-absorptive polymers makes it possible to rapidly absorb water.

When the gelatin content is low, carageenan described in EP-A-443529, the modified alkyl polyvinyl alcohols described in Japanese Patent Application No. 5-339155 and polysaccharides described in JP-A-6-67330 are preferably used as the hydrophilic polymers other than gelatin in terms of the setting property in coating.

In the present invention, the amount of the binders coated in the light-sensitive material or the complex-forming agent sheet is usually 12 $g/m^2$ or less, preferably 10 $g/m^2$ or less, more preferably 5 $g/m^2$ or less, and most preferably 3 $g/m^2$ or less.

In the present invention, organic metal salts can also be used as oxidizing agents in combination with the light-sensitive silver halide emulsions. Of these organic metal salts, organic silver salts are particularly preferably used.

Organic compounds which can be used for formation of the above-mentioned organic silver salt oxidizing agents include benzotriazole compounds, fatty acids and other compounds described in U.S. Pat. No. 4,500,626, columns 52 and 53. Silver acetylide described in U.S. Pat. No. 4,775,613 is also useful. The organic silver salts may be used in combination.

The organic silver salts described above can be used in combination with the light-sensitive silver halides in an amount of 0.01 to 10 mol, preferably 0.01 to 1 mol, per mol of light-sensitive silver halide. The total amount of the organic silver salts and the light-sensitive silver halides coated is 0.05 to 10 $g/m^2$, preferably 0.1 to 4 $g/m^2$, in terms of silver.

In the present invention, reducing agents known in the field of heat developable light-sensitive materials can be used. Further, the reducing agents also include reductive dye-donating compounds given later (in this case, they can be used in combination with other reducing agents). Furthermore, precursors of reducing agents can also be used which themselves have no reductive ability, but exhibit reductive ability by action of nucleophilic reagents or heat during the course of development.

Examples of the reducing agents used in the present invention include reducing agents and precursors of reducing agents described in U.S. Pat. Nos. 4,500,626, column 49 and 50, 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044,JP-A-62-131253, JP-A-62-131256, JP-A-64-13546, pages 40 to 57, JP-A-1-120553, EP-A-220,746, pages 78 to 96.

Combinations of various reducing agents can also be used as disclosed in U.S. Pat. No. 3,039,869.

When nondiffusion reducing agents are used, electron transfer agents and/or precursors thereof can be used in combination to enhance electron transfer between the nondiffusion reducing agents and the silver halides if necessary. It is particularly preferred to use ones described in U.S. Pat. No. 5,139,919 given above and EP-A-418,743. Further, methods for stably introducing them into layers as described in JP-A-2-230143 and JP-A-2-235044 are preferably used.

The electron transfer agents or the precursors thereof can be selected from the reducing agents or the precursors thereof described above. It is desirable that the electron transfer agents or the precursors thereof are higher in their mobility than the nondiffusion reducing agents (electron donors). Particularly useful electron transfer agents are 1-phenyl-3-pyrazolidone derivatives and aminophenol derivatives.

The nondiffusion reducing agents (electron donors) used in combination with the electron transfer agents may be any of the above-mentioned reducing agents, as long as they do not substantially move in the layers of the light-sensitive materials. Preferred examples thereof include hydroquinone derivatives, sulfonamidophenols, sulfonamidonaphthols and compounds described in JP-A-53-110827, U.S. Pat. Nos. 5,032,487, 5,026,634 and 4,839,272 as electron donors, and nondiffusion, reductive dye-donating compounds given later.

Further, precursors of electron donors as described in JP-A-3-160443 are also preferably used.

Furthermore, for various purposes such as color mixture prevention and improvement in color reproduction, the above-mentioned reducing agents can be used in undercoat layers, antihalation layers, intermediate layers or protective layers. Specifically, reducing agents described in EP-A-524,649, EP-A-357,040, JP-A-4-249245, JP-A-2-46450 and JP-A-63-186240 are preferably used. Further, reductive compounds releasing development inhibitors as described in JP-B-3-63733, JP-A-1-150135, JP-A-2-46450, JP-A-2-64634, JP-A-3-43735 and EP-A-451,833 are also used.

In the present invention, the total amount of the reducing agents added is preferably 0.01 to 20 mol, more preferably 0.1 to 10 mol, per mol of silver.

In the present invention, dyes (including dye-donating compounds) can be used as image forming substances together with silver as needed. As an example, a PS (presensitized) plate has the spectral sensitivity within the wavelength region from 300 nm to 500 nm, and a dye (dye-donating compound) having the absorption within this wavelength region can be converted to an image together with a silver image, as long as a light-sensitive material for printing plate making used as a printing original to the PS plate has the discrimination within this wavelength region in its image. Further, a black-and-white image can also be obtained by dyes together with silver, using at least two kinds of dye-donating compounds forming or releasing dyes substantially different in color tone from each other, or a dye-donating compound forming or releasing at least two kinds of dyes substantially different in color tone from each other.

For preventing halation or irradiation, various dyes can be used in the layers constituting the light-sensitive materials used in the present invention. The dyes are preferably dispersed as fine solid grains to incorporate them into the light-sensitive materials, as disclosed in JP-A-3-7931 and JP-A-2-308242.

Specifically, compounds described in *Research Disclosures* stated above can be preferably used.

In the heat developable light-sensitive materials used in the present invention, compounds for activating development and stabilizing images can be used. Preferred examples of such compounds are described in U.S. Pat. No. 4,500,626, columns 51 and 52.

Examples of the dye-donating compounds available in the present invention include compounds forming dyes by oxidation coupling reaction (couplers). The couplers may be either 4-equivalent couplers or 2-equivalent couplers. Further, 2-equivalent couplers having nondiffusion groups as releasing groups and forming diffusion dyes by oxidation coupling reaction are also preferred. The nondiffusion groups may be polymer chains. Examples of color developing agents and the couplers include p-phenylenediamine reducing agents and phenolic or active methylene couplers described in U.S. Pat. No. 3,531,286, p-aminophenol reducing agents described in U.S. Pat. No. 3,761,270, sulfonamidophenol reducing agents described in Belgian Patent 802,519 and *Research Disclosure,* page 32, September, 1975, and combinations of sulfonamidophenol reducing agents and 4-equivalent couplers described in U.S. Pat. No. 4,021,240. Other examples of the color developing agents and the couplers are also described in T. H. James, *The Theory of the Photographic Process,* the fourth edition, pages 291 to 334 and 354 to 361.

As other examples of the dye-donating compounds, nondiffusion dye-donating compounds (thiazolidine compounds) having heterocyclic rings containing nitrogen atoms and sulfur atoms or selenium atoms, said heterocyclic rings being cleaved in the presence of silver ions or soluble silver complexes to release movable dyes as described in JP-A-59-180548, can also be used.

Further examples of the dye-donating compounds include compounds having the function of releasing or diffusing diffusion dyes imagewise. The compounds of this type can be represented by the following formula (L1):

$$((\text{Dye})_m\text{—Y})_n\text{—Z} \qquad \text{(L1)}$$

wherein Dye represents a dye group, a dye group temporarily shifted to a short wavelength, or a dye precursor group; Y represents only a bond or a bonding group; Z represents a group having the property of bringing about the difference in diffusibility of the compound represented by $((\text{Dye})m\text{—Y})_n$—Z corresponding to or reversely corresponding to a light-sensitive silver salt having a latent image imagewise, or releasing (Dye)m—Y to produce the difference in diffusibility between (Dye)m—Y released and $((\text{Dye})m\text{—Y})_n$—Z; m represents an integer of 1 to 5; n represents 1 or 2; and when either m or n is not 1, the plurality of Dye's may be the same or different.

Specific examples of the dye-providing compound represented by formula (LI) include the following compounds (1) to (5). The compounds (1) to (3) form a diffusive dye image (positive dye image) in counter correspondence to the development of silver halide. The compounds (4) and (5) form a diffusive dye image (negative dye image) in correspondence to the development of silver halide.

(1) Dye developing agents in which a hydroquinone developing agent and a dye component are connected to each other can be used as disclosed in U.S. Pat. Nos. 3,134,764, 3,362,819, 3,597,200, 3,544,545, and 3,482,972, and JP-B-3-68387. These dye developing agents are diffusible under alkaline conditions but react with silver halide to become nondiffusible.

(2) As described in U.S. Pat. No. 4,503,137, nondiffusible compounds can be used which release a diffusible dye under alkaline conditions but react with silver halide to lose its capability. Examples of the nondiffusible compounds include compounds which release a diffusible dye by an intramolecular nucleophilic substitution reaction as disclosed in U.S. Pat. No. 3,980,479, and compounds which release a diffusible dye by an intramolecular rearrangement reaction of isooxazolone rings as disclosed in U.S. Pat. No. 4,199,354.

(3) As disclosed in U.S. Pat. Nos. 4,559,290, and 4,783,396, EP-A-220746, JIII Journal of Technical Disclosure 87-6199, and JP-A-64-13546, nondiffusible compounds can be used which react with a reducing agent left unoxidized upon development to release a diffusible dye.

Examples of the nondiffusible compounds include compounds which release a diffusible dye by an intramolecular nucleophilic substitution reaction after reduction as described in U.S. Pat. Nos. 4,139,389, and 4,139,379, and JP-A-59-185333 and JP-A-57-84453, compounds which release a diffusible dye by an intramolecular electron migration reaction after reduction as described in U.S. Pat. No. 4,232,107, JP-A-59-101649 and JP-A-61-88257, and *RD* No. 24025 (1984), compounds which release a diffusible dye by cleaving a single bond after reduction as described in West German Patent 3,008,588A, JP-A-56-142530 and U.S. Pat. Nos. 4,343,893 and 4,619,884, nitro compounds which release a diffusible dye after receiving electrons as described in U.S. Pat. No. 4,450,223, and compounds which release a diffusible dye after receiving electrons as described in U.S. Pat. No. 4,609,610.

Preferred examples of the nondiffusible compounds include compounds containing N—X bond (in which X represents oxygen, sulfur or nitrogen atom) and an electrophilic group per molecule as disclosed in EP-A-220746, JIII Journal of Technical Disclosure 87-6199, U.S. Pat. No. 4,783,396, JP-A-63-201653, JP-A- 63-201654 and JP-A-64-13546, compounds containing $SO_2$—X bond (in which X has the meaning as defined above) and an electrophilic group per molecule as disclosed in JP-A-1-26842, and compounds containing C—X' bond (in which X' has the same meaning as X or represents —$SO_2$—) and an electrophilic group per molecule as disclosed in JP-A-63-271341. Compounds which release a diffusible dye by cleaving a single bond after reduction by K bond conjugated with electron accepting group as disclosed in JP-A-1-161237 and JP-A-1-161342 can also be used.

Of these, the compounds each having an N—X bond and an electron attractive group in one molecule are particularly preferred.

Colored dye-donating compounds are allowed to exist in lower light-sensitive silver halide emulsion layers, whereby the sensitivity can be prevented from being lowered.

The hydrophobic additives such as the dye-donating compounds and the nondiffusion reducing agents can be introduced into the layers of the heat developable light-sensitive materials by known methods such as methods described in U.S. Pat. No. 2,322,027. In this case, high boiling organic solvents as described in U.S. Pat. Nos. 4,555,470, 4,536,466, 4,536,467, 4,587,206, 4,555,476 and 4,599,296, JP-A-63-306439, JP-A-62-8145, JP-A-62-30247 and JP-B-3-62256 can be used in combination with low boiling organic solvents having a boiling point of 50° to 160° C. if necessary. Further, these dye-donating compounds, nondiffusion reducing agents and high boiling organic solvents can be used in combination. The amount of the high boiling organic solvents is 10 g or less per gram of hydrophobic additive to be used, preferably 5 g or less, and more preferably 1 g to 0.1 g. Further, it is 1 ml or less, preferably 0.5 ml or less, and more preferably 0.3 ml or less, per gram of binder.

Furthermore, dispersing methods according to polymerized products described in JP-B-51-39853 and JP-A-51-59943 and addition as dispersed fine grains described in JP-A-62-30242 can also be used.

The compounds substantially insoluble in water can be dispersed in binders as fine grains to add them to the layers, in addition to the above-mentioned methods.

When the hydrophobic compounds are dispersed in hydrophilic colloids, various surfactants can be used. For example, surfactants described in JP-A-59-157636, pages 37 and 38, and *Research Disclosures* stated above can be used.

Further, phosphate surfactants described in West German Patent (OLS) 1,932,299A can also be used.

When dye images are used in combination in the complexing agent sheets, mordants known in the field of photography can be used. Examples thereof include mordants described in U.S. Pat. No. 4,500,626, columns 58 and 59, JP-A-61-88256, pages 32 to 41, and JP-A-1-161236, pages 4 to 7, and mordants described in U.S. Pat. Nos. 4,774,162, 4,619,883 and 4,594,308. Further, dye acceptable polymers described in U.S. Pat. No. 4,463,079 may also be used.

The complexing agent sheets may be provided with supplementary layers such as protective layers, separation layers, undercoat layers, intermediate layers, back layers and curl prevention layers. In particular, it is useful to provide protective layers.

Binders used in the complexing agent sheets used in the present invention are preferably the hydrophilic binders described above. Further, it is desirable to use carageenan as described in EP-A-443,529, polysaccharides such as dextran, and latexes having a glass transition temperature of 40° C. or less as described in JP-B-3-74820, in combination with the above-mentioned binders. Furthermore, it is preferred that mordant polymers known in the field of photography or high water-absorptive polymers described in, e.g., U.S. Pat. No. 4,960,681 and JP-A-62-245260 are used in combination. Polymers such as vinylpyrrolidone, polyvinylimidazole and copolymers of pyrrolidone and imidazole can also be preferably used.

The total amount of the binders coated is preferably 20 g/m$^2$ or less, more preferably 10 g/m$^2$ or less, and most preferably 7 g/m$^2$ or less.

In the layers constituting the heat developable light-sensitive materials and the complexing agent sheets, high boiling organic solvents can be used as plasticizers, slipping agents or separation improvers of the complexing agent sheets from the heat developable light-sensitive materials. Examples thereof include solvents described in *Research Disclosures* stated above and JP-A-62-245253.

Further, various silicone oils (all silicone oils including dimethylsilicone oils and modified silicone oils in which various organic groups are introduced into dimethylsiloxanes) can be used as the above-mentioned agents.

Effective examples thereof include various modified silicone oils described in *Modified Silicone Oils,* Technical Data P6-18B, published by Shinetsu Silicone Co., Ltd., particularly carboxy-modified silicone (trade name: X-22-3710).

Further, silicone oils described in JP-A-62-215953 and JP-A-63-46449 are also effective.

Hardeners used in the layers constituting the heat developable light-sensitive materials and the complexing agent sheets include hardeners described in *Research Disclosures* stated above, U.S. Pat. Nos. 4,678,739, column 41, and 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinylsulfone hardeners (such as N,N'-ethylene-bis(vinylsulfonylacetamido) ethane), N-methylol hardeners (dimethylolurea) and polymer hardeners (compounds described in JP-A-62-234157).

These hardeners are used in an amount of 0.001 to 1 g, preferably 0.005 to 0.5 g, per gram of hydrophilic binder coated. They may be added to any of the layers constituting the light-sensitive materials and the complexing agent sheets, and may be divided to add them to two or more layers.

In the layers constituting the heat developable light-sensitive materials and the complexing agent sheets, various antifoggants or photographic stabilizers and precursors thereof can be used. Examples thereof include compounds described in *Research Disclosures* stated above, U.S. Pat. Nos. 5,089,378, 4,500,627 and 4,614,702, JP-A-64-13546, pages 7 to 9, 57 to 71 and 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, and *Research Disclosure,* 17643 (1978).

These compounds are preferably used in an amount of $5\times10^{-6}$ to $1\times10^{-1}$ mol, more preferably $1\times10^{-5}$ to $1\times10^{-2}$ mol, per mol of silver.

In the layers constituting the heat developable light-sensitive materials and the complexing agent sheets, various surfactants can be used for the purposes of assisting coating, improving separation, improving slipperiness, preventing electric charge, and accelerating development. Examples of the surfactants are described in *Research Disclosures* stated above, JP-A-62-173463 and JP-A-62-183457.

The layers constituting the heat developable light-sensitive materials and the complexing agent sheets may contain organic fluoro compounds for the purposes of improving slipperiness, preventing electric charge and improving separation. Typical examples of the organic fluoro compounds include fluorine surfactants described in JP-B-57-9053, columns 8 to 17, JP-A-61-20944 and JP-A-62-135826, and hydrophobic fluorine compounds such as oily fluorine compounds (for example, fluorine oils) and solid fluorine compounds (for example, ethylene tetrafluoride resins).

The heat developable light-sensitive materials and the complexing agent sheets can contain matte agents for the purposes of preventing adhesion, improving slipperiness and delustering surfaces of the light-sensitive materials and the complexing agent sheets. The matte agents include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in *Research Disclosures* stated above can be used. These matte agents can be added not only to the uppermost layers (protective layers), but also to lower layers as needed.

Besides, the layers constituting the heat developable light-sensitive materials and the complexing agent sheets may contain heat solvents, antifoaming agents, microbicidal antifungal agents and colloidal silica. Examples of these additives are described in JP-A-61-88256, pages 26 to 32, JP-A-3-11338 and JP-B-2-51496.

In the present invention, image formation accelerating agents can be used in the heat developable light-sensitive materials and/or the complexing agent sheets. The image formation accelerating agents can be classified into bases or base precursors, nucleophilic compounds, high boiling organic solvents (oils), heat solvents, surfactants, compounds having interaction with silver or silver ions according to the physicochemical functions. However, these groups of substances generally have combined functions, and therefore, they have usually combinations of some of the above-mentioned accelerating effects. The details thereof are described in U.S. Pat. No. 4,678,739, columns 38 to 40.

In the present invention, various development stoppers can be used in the heat developable light-sensitive materials and/or the complexing agent sheets for obtaining always constant images against fluctuations in processing temperature and processing time on development.

The development stopper as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors releasing acids by heating, electrophilic compounds which conduct replacement reaction with coexisting bases by heating, nitrogen-containing heterocyclic compounds, mercapto compounds and precursors thereof. More specifically, they are described in JP-A-62-253159, pages 31 and 32.

In the present invention, supports which can endure processing temperatures are used as supports employed in the heat developable light-sensitive materials and the complexing agent sheets. In general, the supports include photographic supports such as paper and synthetic polymers (films) described in *Shashin Kohgaku no Kiso* (*Higinen Shashin*) (The Fundamentals of Photographic Engineering (Nonsilver Photograph)), pages 223 to 240, edited by Nippon Shashin Gakkai, Corona Publishing Co. Ltd. (1979). Specifically, there are used polyethylene terephthalate, polyethylene naphthalate, polycarbonates, polyvinyl chloride, polystyrene, polypropylene, polyimides, polyarylates, cellulose derivatives (for example, cellulose triacetate), films thereof containing pigments such as titanium oxide, synthetic paper produced from propylene by film methods, mixed paper produced from pulp of synthetic resins such as polyethylene and natural pulp, Yankee paper, baryta paper, coated paper (particularly, cast-coated paper), metals, cloth, or glass.

They can be used alone or as supports coated with synthetic polymers such as polyethylene on one side or both sides. The laminated layers can contain pigments such as titanium oxide, ultramarine and carbon black or dyes if necessary.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

Back surfaces of these supports may be coated with hydrophilic binders and semiconductive metal oxides such as alumina sols and tin oxide, or with antistatic agents such as carbon black. Specifically, supports described in JP-A-63-220246 can be used.

It is desirable to design so as to give a surface resistivity of $10^{12}$ Ω.cm or less.

For improving adhesion to the hydrophilic binders, various surface treatments or undercoating treatments are preferably applied to surfaces of the supports.

In particular, when requirements for heat resistance or curling characteristics are severe, supports described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, and JP-A-6-118561 can be used as the supports for the light-sensitive materials.

Methods for exposing the heat developable light-sensitive materials to record images include, for example, methods of directly taking landscape photographs or human subject photographs by use of cameras, methods of exposing the light-sensitive materials through reversal films or negative films by use of printers, enlargers, methods of subjecting original pictures to scanning exposure through slits by use of exposing devices of copying machines, methods of allowing light emitting diodes, various lasers (such as laser diodes and gas lasers) to emit light by image information through electric signals to subject the light-sensitive materials to scanning exposure (methods described in JP-A-2-129625), and methods of supplying image information to image displays such as CRTs, liquid crystal displays, electroluminescence displays and plasma displays to expose the light-sensitive materials directly or through optical systems.

As described above, light sources and exposing methods such as natural light, tungsten lamps, light emitting diodes, laser sources and CRT light sources described in U.S. Pat. No. 4,500,626, column 56, JP-A-2-53378 and JP-A-2-54672 can be used to record images on the heat developable light-sensitive materials.

Light sources can be used in which blue light emitting diodes recently remarkably developed are combined with green light emitting diodes and red light emitting diodes. In particular, exposing devices described in Japanese Patent Application Nos. 6-40164, 6-40012, 6-42732, 6-86919, 6-93421, 6-94820, 6-96628 and 6-149609 can be preferably used.

Further, images can also be exposed using wavelength converting elements in which non-linear optical materials are combined with coherent light sources such as laser beams. Here, the non-linear optical material is a material which can express non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the forms of the wavelength converting elements, the single crystal optical waveguide path type and the fiber type are known, and both are useful.

Further, as the above-mentioned image information, there can be utilized image signals obtained from video cameras or electronic still cameras, television signals represented by the Nippon Television Signal Criteria (NTSC), image signals obtained by dividing original pictures into many picture elements with scanners and image signals produced by use of computers represented by CGs and CADs.

The light-sensitive materials and/or the complexing agent sheets can be used for various applications. For example, they can be sued as printing materials such as printing materials of the black-and-white positive type or negative type and lithographic materials, or X-ray light-sensitive materials. Further, they can also be used as photographing materials. In this case, it is preferred that supports having magnetic layers described in JP-A-4-124645, JP-A-5-40321, JP-A-6-35029 or JP-A-6-317875 are used to record photographed information.

The light-sensitive materials and/or the complexing agent sheets used in the present invention may have conductive heating layers as heating means for heat development and diffusion transfer of silver salts. In this case, heating elements described in JP-A-61-145544 can be utilized.

In the present invention, it is preferred that heating carried out in the presence of a trace amount of water to conduct development and transfer at the same time as described in U.S. Pat. Nos. 4,704,345 and 4,740,445, and JP-A-61-238056. In this system, the heating temperature is preferably 50° C. to 100° C.

In the present invention, any water may be used as long as it is generally used. For example, distilled water, tap water, well water, or mineral water can be used. In heat developing equipment in which the light-sensitive materials and the complexing agent sheets are processed, water may be used in the disposable form, or repeatedly circulated. The latter case results in use of water containing components eluted from the light-sensitive materials. Further, equipment and water described in JP-A-63-144354, JP-A-63-144355, JP-A-62-38460, or JP-A-3-210555 may be used. Furthermore, water may contain water-soluble low boiling solvents, surfactants, antifoggants, complex forming compounds with slightly soluble metal salts, antifungal agents or microbiocides.

Water can be given to the light-sensitive materials or the complexing agent sheets or both, but preferably given to the light-sensitive materials.

The amount of water used in the present invention is at least 0.1 time the weight of the whole coated films of the light-sensitive material and the complexing agent sheet, preferably within the range of 0.1 time the weight of the whole coated films to the weight of water corresponding to the maximum swelled volume of the whole coated films, and more preferably within the range of 0.1 time the weight of the whole coated films to the amount obtained by the subtraction of the weight of the whole coated films from the weight of water corresponding to the maximum swelled volume of the whole coated films.

Preferred examples of methods for giving water include methods described in JP-A-62-253159, page 5, and JP-A-63-85544. Further, solvents enclosed in microcapsules or hydrated can be previously contained in the heat developable light-sensitive materials or dye fixing elements or both.

The temperature of water to be given may be 30° C. to 60° C. as described in JP-A-63-85544. In particular, in order to prevent bacteria in water from propagating, it is useful to keep the temperature of water at 45° C. or more.

Hydrophilic heat solvents which are solid at ordinary temperature and soluble at high temperatures can be contained in the light-sensitive materials and/or the complexing agent sheets. The solvents may be contained in any of the light-sensitive silver halide emulsion layers, the intermediate layers and the protective layers of the light-sensitive materials, and any layers of the complexing agent sheets. Examples of hydrophilic heat solvents include urea derivatives, pyridine derivatives, amides, sulfonamides, imides, alcohols, oximes and other heterocyclic compounds.

Heating methods in the development and/or transfer stage include methods of bringing the light-sensitive materials and the complexing agent sheets into contact with heated blocks, heated plates, hot pressers, heat rolls, heat drums, halogen lamp heaters, infrared or far infrared lamp heaters, and methods of passing them through atmospheres of high temperatures.

The heat developable light-sensitive materials and the complexing agent sheets can be placed one over the other by methods described in JP-A-62-253159 and JP-A-61-147244, page 27.

Any of various heat development devices can be used for processing the light-sensitive elements in the present invention. For example, devices described in JP-A-59-75247, JP-A-59-177547, JP-A-59-181353, JP-A-60-18951, and JU-A-62-25994 (the term "JU-A" as used herein means an "unexamined published Japanese utility model application") are preferably used. As commercially available devices, there can be used Pictrostat 100, Pictrostat 200, Pictrostat 300, Pictrography 3000 and Pictrography 2000 manufactured by Fuji Photo Film Co., Ltd.

The present invention will be further illustrated in greater detail with reference to the following examples, which are, however, not to be construed as limiting the invention. All parts, percents, ratios and the like are by weight unless otherwise indicated.

EXAMPLES

Example 1-1

Preparation of Emulsion 1-I

Twenty grams of gelatin and 3 g of sodium chloride are dissolved in 650 ml of water at 40° C. with stirring. After complete dissolution, 15 ml of a 0.1% solution of compound (1) in methanol is added. The resulting solution is stirred, and a solution of silver nitrate (obtained by adding water to 100 g of $AgNO_3$ to bring the volume to 600 ml) is added thereto for 5 minutes while maintaining the temperature at 40° C. After an elapse of 20 seconds from the start of addition of the silver nitrate solution, a halogen solution (obtained by adding water to 34.4 g of NaCl to bring the volume to 600 ml) is added for 4 minutes and 40 seconds. After the termination of addition, the solution is maintained at 40° C. for 20 minutes, followed by addition of 680 ml of water, 15 ml of 1N sulfuric acid and 15 ml of a 1% aqueous solution of precipitant (1). At this time, the pH of the solution is about 4.0. After precipitation of silver halide grains, 2200 ml of the supernatant is removed to eliminate a salt. Then, 2000 ml of water is further added, and 2200 ml of the supernatant is similarly removed. To the resulting solution, 22 g of gelatin, 2 ml of 1N NaOH and 4 ml of a 10% aqueous solution of NaCl are added, and 70 mg of preservative (1) is further added to obtain a silver chloride emulsion. The pH of this silver chloride emulsion is 6.0, and the yield thereof is about 600 g.

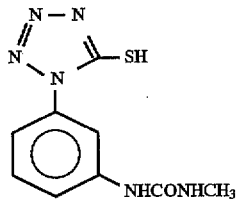

Compound (1)

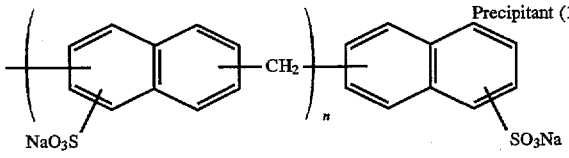

Precipitant (1)

n = 3–4

-continued

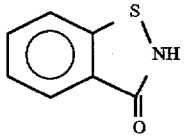

Preservative (1)

Preparation of Emulsion 1-II

Twenty grams of gelatin, 3 g of sodium chloride and 0.3 g of potassium bromide are dissolved in 650 ml of water at 40° C. with stirring. After complete dissolution, 15 ml of a 0.1% solution of compound (1) in methanol is added. The resulting solution is stirred, and a solution of silver nitrate (obtained by adding water to 100 g of $AgNO_3$ to bring the volume to 600 ml) is added thereto for 5 minutes while maintaining the temperature at 40° C. After an elapse of 20 seconds from the start of addition of the silver nitrate solution, a halogen solution (obtained by adding water to 10.3 g of NaCl and 49 g of KBr to bring the volume to 600 ml) is added for 4 minutes and 40 seconds. After the termination of addition, the solution is maintained at 40° C. for 20 minutes, followed by addition of 680 ml of water, 15 ml of 1N sulfuric acid and 15 ml of a 1% aqueous solution of precipitant (1). At this time, the pH of the solution is about 4.0. After precipitation of silver halide grains, 2200 ml of the supernatant is removed to eliminate a salt. Then, 2000 ml of water is further added, and 2200 ml of the supernatant is similarly removed. To the resulting solution, 22 g of gelatin, 2 ml of 1N NaOH and 4 ml of a 10% aqueous solution of NaCl are added, and 70 mg of preservative (1) is further added to obtain a silver chlorobromide emulsion (containing 70 mol % of Br). The pH of this silver chlorobromide emulsion is 6.0, and the yield thereof is about 600 g.

Preparation of Emulsions 1-III and 1-IV

Silver chlorobromide emulsion 1-III containing 15 mol % of Br and silver chlorobromide emulsion 1-IV containing 5 mol % of Br were prepared in a manner similar to that of emulsion 1-II.

Preparation of Dispersion of Reducing Agent, 1,5-Diphenyl-3-pyrazolidone

Ten grams of 1,5-diphenyl-3-pyrazolidone, 0.1 g of surfactant (1) and 0.5 g of surfactant (2) were added to 90 ml of a 3% aqueous solution of lime-treated gelatin, and dispersed for 30 minutes by use of glass beads having a mean grain size of 0.75mm. The glass beads were separated to obtain a gelatin dispersion of the reducing agent.

A gelatin dispersion of antihalation dye (1) and a gelatin dispersion of zinc hydroxide were prepared according to methods based on this method.

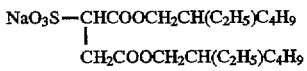

Surfactant (1)

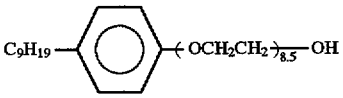

Surfactant (2)

-continued

Antihalation Dye (1)

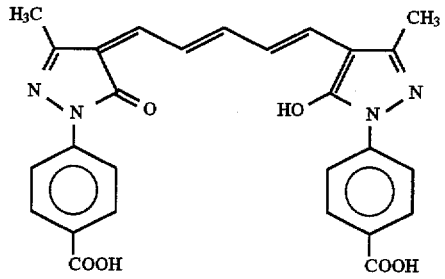

Zinc Thiosalicylate

Stabilizer Precursor (1)

Using the materials described above, light-sensitive material 101 shown in Table 1 was prepared.

TABLE 1

CONSTITUTION OF LIGHT-SENSITIVE MATERIAL 101

| Layer No. | Layer Name | Additive | Amount Coated ($mg/m^2$) |
|---|---|---|---|
| 5th Layer | Protective Layer II | Acid-Treated Gelatin | 252 |
| | | PMMA Latex (size: 3 μm) | 12 |
| | | Surfactant (3) | 2 |
| | | Surfactant (1) | 18 |
| | | Sumikagel L5-H (manufactured by Sumitomo Chemical Co., Ltd.) | 130 |
| 4th Layer | Protective Layer I | Lime-Treated Gelatin | 344 |
| | | Zinc Hydroxide | 600 |
| | | Surfactant (1) | 5 |
| | | Dextran | 16 |
| | | Water-Soluble Polymer (1) | 6 |
| | | Surfactant (2) | 25 |
| 3rd Layer | Emulsion Layer | Light-sensitive Silver Halide Emulsion (1-I) | 1420 (in terms of silver) |
| | | Lime-Treated Gelatin | 660 |
| | | Sensitizing Dye (1) | 4 |
| | | Surfactant (4) | 32 |
| | | Water-Soluble Polymer (1) | 36 |
| 2nd Layer | Intermediate Layer | Lime-Treated Gelatin | 950 |
| | | 1,5-Diphenyl-3-pyrazolidone | 1650 |
| | | Dextran | 86 |
| | | Hardener (1) | 24 |
| | | Surfactant (1) | 16 |
| | | Surfactant (2) | 80 |
| | | Water-Soluble Polymer (1) | 22 |
| 1st Layer | AH Layer | Stabilizer Precursor (1) | 300 |
| | | Lime-Treated Gelatin | 540 |
| | | Surfactant (1) | 3 |
| | | Surfactant (2) | 15 |
| | | Antihalation Dye (1) | 150 |
| | | Water-Soluble Polymer (1) | 36 |

Support: Polyethylene Terephthalate (having a gelatin undercoat and a thickness of 100 μm)

Surfactant (3)

$C_8F_{17}SO_2N(C_3H_7)CH_2COOK$

Surfactant (4)

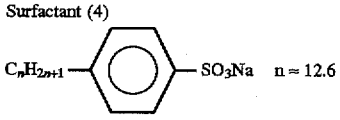

TABLE 1-continued

CONSTITUTION OF LIGHT-SENSITIVE MATERIAL 101

| Layer No. | Layer Name | Additive | Amount Coated ($mg/m^2$) |
|---|---|---|---|

Sensitizing Dye (1)

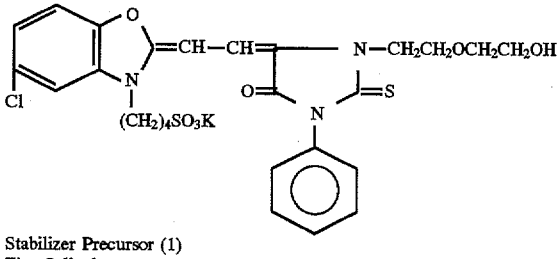

Stabilizer Precursor (1)

Zinc Salicylate

Water-Soluble Polymer (1)

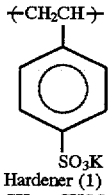

Hardener (1)

$CH_2=CHSO_2CH_2SO_2CH=CH_2$

Then, light-sensitive silver halide emulsions 1-II, 1-III and 1-IV were used in place of light-sensitive silver halide emulsion 1-I in light-sensitive material 101 so as to give the same amount of silver coated, thus preparing light-sensitive materials 102, 103 and 104, respectively.

Thereafter, complexing agent sheet $R_1$ having the constitution shown in Table 2 was prepared. Uracil, a compound represented by formula (I), was added as a 10% aqueous solution containing equimolar sodium hydroxide.

TABLE 2

CONSTITUTION OF COMPLEXING AGENT SHEET R1

| Layer No. | Additive | Amount Coated ($mg/m^2$) |
|---|---|---|
| 3rd Layer | Gelatin | 250 |
| | Sumikagel L5-H | 10 |
| | Surfactant (5) | 27 |
| | Hardener (2) | 48 |
| | Colloidal Silver (0.02 μm) | 10 |
| 2nd Layer | Gelatin | 800 |
| | Sumikagel L5-H | 240 |
| | Dextran | 660 |
| | Polymer Dispersion (Nipol LX814 manufactured by Nippon Zeon Co., Ltd.)) | 600 |
| | Polymer (P-4) | 2400 |
| | Surfactant (3) | 10 |
| | Guanidine Picolinate | 2800 |
| | Uracil | 600 |
| 1st Layer | Gelatin | 150 |
| | Sumikagel L5-H | 40 |
| | Surfactant (3) | 6 |
| | Surfactant (5) | 27 |

Support: Paper Support Laminated with Polyethylene (having a thickness of 120 μm)

Surfactant (5)

$C_{11}H_{23}CONHCH_2CH_2CH_2{}^{+}N(CH_3)_2CH_2COO^{-}$

TABLE 2-continued

CONSTITUTION OF COMPLEXING AGENT SHEET R1

| Layer No. | Additive | Amount Coated ($mg/m^2$) |
|---|---|---|
| Hardener (2) | $CH_2CH-CH_2O(CH_2)_4OCH_2-CHCH_2$ (O, O) | |

Light-sensitive materials 101 to 104 obtained as described above were each exposed imagewise, followed by immersion in water maintained at 40° C. for 2.5 seconds. Then, each light-sensitive material was squeezed with rolls, and immediately, the complexing agent sheet was placed thereon so that a film surface thereof comes into contact with the complexing agent sheet. Subsequently, each light-sensitive material was heated for 20 seconds by use of a heat drum adjusted to such a temperature that the temperature of the water-absorbed film surface was elevated to 75° C. When the complexing agent sheet was peeled off, black-and-white image was obtained on the light-sensitive material.

The visual densities (the maximum density <Dmax> and the minimum density <Dmin>) of the resulting transmission image were measured by use of a Macbeth densitometer. Results thereof are shown in Table 3. The silver amount of an unexposed portion transferred to the complexing agent sheet was further analyzed, and values thereof are also shown in Table 3.

TABLE 3

| Light-sensitive Material No. | Dmax | Dmin | Amount of Silver Coated ($mg/m^2$) |
|---|---|---|---|
| 101 (Invention) | 2.20 | 0.20 | 1030 |
| 102 (Comparison) | 2.35 | 0.39 | 390 |
| 103 (Comparison) | 2.31 | 0.31 | 750 |
| 104 (Invention) | 2.24 | 0.22 | 925 |

The results shown in Table 3 reveals that light-sensitive materials 101 and 104 using emulsions 1-I and 1-IV, respectively, smaller in Br content provide images having high Dmax and low Dmin. The results further indicate that use of the silver halide emulsions lower in Br content results in a smaller amount of silver transferred.

Furthermore, when the light-sensitive materials processed were stored in an illuminated room, light-sensitive material 102 having a high Br content was increased in Dmin by printout.

Example 1-2

Complexing agent sheets R2 to R8 were prepared which had the same constitution as complexing agent sheet R1 with the exception that polymer (P-4) and uracil used in the second layer were replaced by the compounds shown in Table 4. Using light-sensitive material 101 used in Example 1-1, the sheets were treated in the same manner as with Example 1-1. The Dmax, the Dmin and the degree of printout of the resulting images are also shown in Table 4.

TABLE 4

| Complexing Agent Sheet No. | Polymer ($mg/m^2$) | Fixing Agent ($mg/m^2$) | Dmax | Dmin | Printout |
|---|---|---|---|---|---|
| R1 (Invention) | P-4 (2400) | Uracil (600) | 2.20 | 0.20 | – |
| R2 (Invention) | Not added | Uracil (600) | 1.56 | 0.18 | – |
| R3 (Comparison) | P-4 (2400) | Not added | 2.52 | 1.58 | ++ |
| R4 (Invention) | Polyvinyl Pyrrolidone K-30 (1200) | Uracil (300) 4-Methyluracil (300) | 1.88 | 0.20 | – |
| R5 (Invention) | Polyimidazole (1700) | 4-Methyluracil (600) | 2.16 | 0.22 | – |
| R6 (Invention) | P-4 (2400) | Hydantoin (600) | 2.05 | 0.19 | – |
| R7 (Comparison) | Not added | $Na_2S_2O_3$ (600) | 1.02 | 0.15 | – |
| R8 (Invention) | P-6 (2000) | Succinimide (600) | 2.15 | 0.22 | + |

Note:
For the degree of printout, "–" shows "none". "+" shows "a little", and "++" shows "much".

The results shown in Table 4 reveals that use of the polymers of the present invention increases the Dmax of images, and that, of the compounds represented by formula (I), the uracils and hydantoins are preferred.

Example 1-3

Complexing agent sheet R9 was prepared which had the same constitution as complexing agent sheet R1 with the exception that palladium sulfide having a mean grain size of 0.005 μm was used as the physical development nuclei in an amount of 1 $mg/m^2$ in place of colloidal silver used in the third layer. Using light-sensitive material 101 used in Example 1-1, the sheet was treated in the same manner as with Example 1-1. As a result, the light-sensitive material provided a negative image having a Dmax of 2.14 and a Dmin of 0.21, and the complexing agent sheet provided a positive image having a Dmax of 1.75 and a Dmin of 0.13.

The results reveal that both the negative and positive images can be obtained at the same time for a short period of time by using physical development nuclei having a low light absorption.

The silver salt transfer type heat development using the complexing agent sheets containing the compounds having imide rings represented by formula (I) provide silver images excellent in sharpness on the light-sensitive materials for a short period of time. Further addition of the polymers having the repeating units represented by formula (II) and/or formula (III) as constituents to the complexing agent sheets increases the image density. The images obtained according to the present invention are stable against light.

Example 2-1

Preparation of Light-sensitive Silver Halide Emulsion 2-I

Solution 2-I shown in Table 6 was added to an aqueous solution of gelatin having the composition shown in Table 5 with sufficient stirring for 1 minute. After an elapse of 20 seconds from the start of addition of solution 2-I, solution 2-II was added for 40 seconds. After an elapse of 2 minutes, solutions 2-III and 2-IV were concurrently added for 4 minutes.

TABLE 5

| COMPOSITION OF AQUEOUS SOLUTION OF GELATIN | |
|---|---|
| $H_2O$ | 650 ml |
| Lime-Treated Gelatin | 20 g |
| NaCl | 3 g |
| Solvent for Silver Halide (a) | 0.015 g |
| Temperature | 40° C. |

TABLE 6

| | Solution 2-I | Solution 2-II | Solution 2-III | Solution 2-IV |
|---|---|---|---|---|
| $AgNO_3$ | 20 g | | 80 g | |
| NaCl | | 4.91 g | | 29.5 g |
| Total Amount | Water to make 120 ml | Water to make 85.7 ml | Water to make 480 ml | Water to make 514 ml |

Solvent for Silver Halide (a)

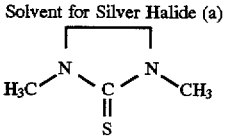

After conventional washing and salt removal (conducted at pH 4.0 using precipitant (a)), 22 g of delimed gelatin was added and dispersed therein. After adjustment to pH 6.0, 4 ml of a 10% aqueous solution of sodium hydroxide was added, and 70 mg of preservative (a) was further added thereto to obtain a silver chloride emulsion having a grain size of 0.15 μm. The yield of this emulsion was 630 g.

Precipitant (a)

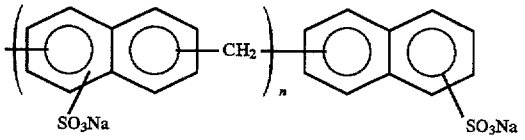

n = 3~4

Preservative (a)

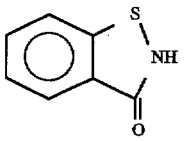

Preparation of Silver Halide Emulsion 2-II

A silver chlorobromide emulsion containing 85 mol % of silver chloride was prepared in the same manner as with silver halide emulsion 2-I with the exception that the composition of the aqueous solution of gelatin and the compositions of solutions 2-II and 2-IV were changed as shown in Tables 7 and 8, respectively.

TABLE 7

| COMPOSITION OF AQUEOUS SOLUTION OF GELATIN | |
|---|---|
| $H_2O$ | 650 ml |
| Lime-Treated Gelatin | 20 g |
| NaCl | 3 g |
| KBr | 0.3 g |

TABLE 7-continued

| COMPOSITION OF AQUEOUS SOLUTION OF GELATIN | |
|---|---|
| Solvent for Silver Halide (a) | 0.015 g |
| Temperature | 40° C. |

TABLE 8

| | Solution 2-I | Solution 2-II | Solution 2-III | Solution 2-IV |
|---|---|---|---|---|
| $AgNO_3$ | 20 g | | 80 g | |
| NaCl | | 4.18 g | | 25.1 g |
| KBr | | 1.5 g | | 9.0 g |
| Total Amount | Water to make 120 ml | Water to make 85.7 ml | Water to make 480 ml | Water to make 514 ml |

Preparation of Silver Halide Emulsion 2-III

A silver chlorobromide emulsion containing 70 mol % of silver chloride was prepared in the same manner as with silver halide emulsion 2-II with the exception that the compositions of solutions 2-II and 2-IV were changed as shown in Table 9.

TABLE 9

| | Solution 2-I | Solution 2-II | Solution 2-III | Solution 2-IV |
|---|---|---|---|---|
| $AgNO_3$ | 20 g | | 80 g | |
| NaCl | | 3.46 g | | 20.7 g |
| KBr | | 3.0 g | | 18.0 g |
| Total Amount | Water to make 120 ml | Water to make 85.7 ml | Water to make 480 ml | Water to make 514 ml |

Preparation of Silver Halide Emulsion 2-IV

A silver chlorobromide emulsion containing 30 mol % of silver chloride was prepared in the same manner as with silver halide emulsion 2-II with the exception that the compositions of solutions 2-II and 2-IV were changed as shown in Table 10.

TABLE 10

| | Solution 2-I | Solution 2-II | Solution 2-III | Solution 2-IV |
|---|---|---|---|---|
| $AgNO_3$ | 20 g | | 80 g | |
| NaCl | | 1.47 g | | 8.83 g |
| KBr | | 7.0 g | | 42.0 g |
| Total Amount | Water to make 120 ml | Water to make 85.7 ml | Water to make 480 ml | Water to make 514 ml |

Preparation of Dispersion of Reducing Agent, 1,5-Diphenyl-3-pyrazolidone

Ten grams of 1,5-diphenyl-3-pyrazolidone and 0.1 g of Demol manufactured by Kao Corp. were added to 90 ml of a 5.7% aqueous solution of lime-treated gelatin, and dispersed for 30 minutes by use of glass beads having a mean grain size of 0.75 mm. The glass beads were separated to obtain a gelatin dispersion of the reducing agent.

A gelatin dispersion of solid antihalation dye (1) was prepared according to a method based on this method.

Antihalation Dye (a)

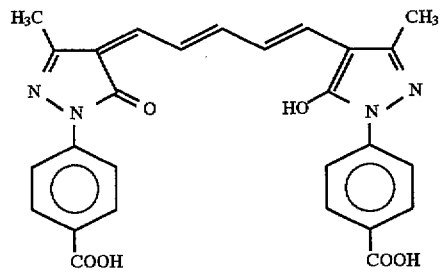

Preparation of Dispersion of Zinc Hydroxide

To 100 ml of a 4% aqueous solution of gelatin, 12.5 g of zinc hydroxide having a mean grain size of 0.2 μm, 1 g of carboxymethyl cellulose as a dispersing agent, and 0.1 g of polysodium acrylate were added, and dispersed by use of glass beads having mean grain size of 0.75 mm in a mill for 30 minutes. The glass beads were separated to obtain a gelatin dispersion of zinc hydroxide.

Using the materials described above, light-sensitive material 201 shown in Table 11 was prepared. Sensitizing dye (a) was added in preparing the coating solution.

TABLE 11

CONSTITUTION OF LIGHT-SENSITIVE MATERIAL 201

| Layer Nane | Additive | Amount Coated ($mg/m^2$) |
|---|---|---|
| 5th Layer (Protective Layer II) | Acid-Treated Gelatin | 166 |
| | PMMA Latex (3 μm) | 12 |
| | Sumikagel L-5H | 60 |
| | Surfactant (a) | 2 |
| | Surfactant (b) | 5 |
| 4th Layer (Protective Layer I) | Lime-Treated Gelatin | 240 |
| | Zinc Hydroxide | 900 |
| | Surfactant (b) | 5 |
| | Dextran | 16 |
| | Water-Soluble Polymer | 5 |
| | Hardener (a) | 35 |
| 3rd Layer (Emulsion Layer) | Light-sensitive Silver Halide Emulsion (2-I) | 1200 (in terms of silver) |
| | Sensitizing Dye (a) | 6.7 |
| | Lime-Treated Gelatin | 660 |
| | Surfactant (b) | 23 |
| | Water-Soluble Polymer (a) | 7 |
| 2nd Layer (Intermediate Layer) | 1,5-Diphenyl-3-pyrazolidone | 1507 |
| | Lime-Treated Gelatin | 753 |
| | Dextran | 62 |
| | Surfactant (b) | 8 |
| | Water-Soluble Polymer (a) | 4 |
| 1st Layer (Antihalation Layer) | Lime-Treated Gelatin | 660 |
| | Antihalation Dye (a) | 150 |
| | Surfactant (b) | 15 |
| | Water-Soluble Polymer (a) | 35 |

Support: Polyethylene Terephthalate (having a gelatin undercoat and a thickness of 100 μm)

Surfactant (a)

$C_8F_{17}SO_2N(C_3H_7)CH_2CH_2O(CH_2CH_2O)_{15}H$

Surfactant (b)

$NaO_3S-CH(CH_2COOCH_2CH(C_2H_5)C_4H_9)COOCH_2CH(C_2H_5)C_4H_9$

Sensitizing Dye (a)

TABLE 11-continued

CONSTITUTION OF LIGHT-SENSITIVE MATERIAL 201

| Layer Nane | Additive | Amount Coated ($mg/m^2$) |
|---|---|---|

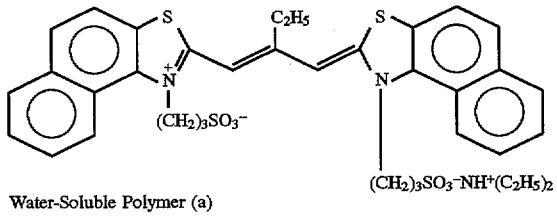

Water-Soluble Polymer (a)

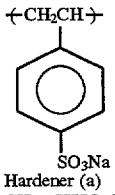

Hardener (a)

$CH=CHSO_2CHSO_2CH=CH_2$

Then, light-sensitive silver halide emulsions 2-II, 2-III and 2-IV were used in place of light-sensitive silver halide emulsion 2-I in light-sensitive material 201 so as to give the same amount of silver coated, thus preparing light-sensitive materials 202, 203 and 204, respectively.

Thereafter, complexing agent sheet R21 having the constitution shown in Table 12 was prepared.

TABLE 12

CONSTITUTION OF COMPLEXING AGENT SHEET R21

| Layer Name | Additive | Amount Coated ($mg/m^2$) |
|---|---|---|
| 4th Layer (Protective Layer) | κ-Carrageenan | 58 |
| | Sumikagel L5-H | 164 |
| | Lime-Treated Gelatin | 32 |
| | Surfactant (b) | 8 |
| | Surfactant (c) | 7 |
| | Surfactant (d) | 61 |
| | Colloidal Silver Grains (0.02 μm) | 10 |
| | Potassium Nitrate | 25 |
| 3rd Layer (Intermediate Layer) | Lime-Treated Gelatin | 245 |
| | Sumikagel L5-H | 26 |
| | Surfactant (e) | 9 |
| | Hardener (b) | 18 |
| 2nd Layer (Complexing Agent Layer) | Lime-Treated Gelatin | 1300 |
| | Sumikagel L5-H | 124 |
| | Dextran | 620 |
| | Polymer Dispersion | 600 |
| | Water-Soluble Polymer (b) | 2280 |
| | Guanidine Picolinate | 2700 |
| | Sodium Sulfite | 1100 |
| | Surfactant (e) | 22 |
| 1st Layer (Intermediate Layer) | Lime-treated Gelatin | 185 |
| | Sumikagel L5-H | 8 |
| | Surfactant (b) | 9 |
| | Hardener (b) | 18 |

Support: Polyethylene Terephthalate (having a gelatin undercoat and a thickness of 100 μm)

Surfactant (c)

$C_8F_{17}SO_2N(C_3H_7)CH_2COOK$

TABLE 12-continued

CONSTITUTION OF COMPLEXING AGENT SHEET R21

| Layer Name | Additive | Amount Coated ($mg/m^2$) |
|---|---|---|
| Surfactant (d) | $C_{11}H_{23}CONH(CH_2)_3N^+(CH_3)_2CH_2COO^-$ | |
| Surfactant (e) | $C_{12}H_{25}$—C$_6$H$_4$—$SO_3Na$ | |
| Hardener (b) | $CH_2CH(O)CH_2-O-(CH_2)_2-O-CH_2-CH(O)CH_2$ | |
| Water-Soluble Polymer (b) | $(CH_2-CH(N\text{-}C_5H_4))_{60}(CH_2-CH(N\text{-}C_4H_6O))_{30}(CH_2-CH(C_6H_4SO_3K))_{10}$ | |

Light-sensitive materials 201 to 204 obtained as described above were each exposed imagewise through a wedge with a tungsten lamp having a color temperature of 2854° K. at 2500 Lux for 1 second, Each light-sensitive material exposed was immersed in water maintained at 40° C. for 2.5 seconds, followed by squeezing with rolls, and immediately, the complexing agent sheet was placed thereon so that a film surface thereof comes into contact with the complexing agent sheet. Subsequently, each light-sensitive material was heated for 15 seconds by use of a heat drum adjusted to such a temperature that the temperature of the water-absorbed film surface was elevated to 75° C. When the complexing agent sheet was peeled off, black-and-white image was obtained on the light-sensitive material.

The UV densities (the maximum density <Dmax> and the minimum density <Dmin>) of the resulting transmission image were measured by use of a densitometer (TR924, manufactured by Macbeth Co.). Further, light-sensitive materials 201 to 204 processed were allowed to stand in an illuminated room, and the degree of printout was evaluated. Results thereof are shown in Table 13.

TABLE 13

| Light-sensitive Material | Dmax | Dmin | Printout |
|---|---|---|---|
| 201 (Invention) | 2.47 | 0.34 | o |
| 202 (Invention) | 2.43 | 0.36 | o |
| 203 (Comparison) | 2.21 | 0.45 | Δ |
| 204 (Comparison) | 1.95 | 0.52 | x |

Note:
For the degree of printout, "o" shows "none", "Δ" shows "a little", and "x" shows "much".

The results shown in Table 13 reveals that the light-sensitive materials containing 80 mol % or more of silver halide obtained according to the present invention are high in Dmax and low in Dmin. A decrease in silver halide content resulted in deteriorated printout.

Example 2-2

Complexing agent sheets R22 to R26 were prepared which had the same constitution as complexing agent sheet R21 with the exception that sodium sulfite used in the second layer were replaced by the compounds shown in Table 14 which are typical solvents for silver halides or typical reducing agents. Using light-sensitive material 201 used in Example 2-1, the sheets were treated in the same manner as with Example 2-1. The Dmax, the Dmin and the degree of printout of the resulting images are also shown in Table 14. The results shown in Table 14 indicate that the sulfite used in the present invention can attain high Dmax and low Dmin, and inhibit printout, compared with other solvents for silver halides and reducing agents. Further, the results reveals that use of sodium sulfite significantly reduces residual color caused by the sensitizing dye and/or the antihalation dye.

TABLE 14

| Complexing Agent Sheet | Compound ($mg/m^2$) | Dmax | Dmin | Printout |
|---|---|---|---|---|
| R21 (Invention) | $Na_2SO_3$ (1.1) | 2.20 | 0.20 | o |
| R22 (Comparison) | Not added | 2.44 | 0.60 | x |
| R23 (Comparison) | KSCN (0.77) | 1.60 | 0.37 | o |
| R24 (Comparison) | $Na_2S_2O_3$ (1.28) | 1.26 | 0.29 | o |
| R25 (Comparison) | Thiourea (0.62) | 1.31 | 0.85 | o |
| R26 (Comparison) | Ascorbic Acid (1.56) | 2.35 | 0.55 | x |

Note:
For the degree of printout, "o" shows "none", "Δ" shows "a little", and "x" shows "much".

Example 2-3

Preparation of Light-sensitive Silver Halide Emulsion 2-V

The temperature of an aqueous solution of gelatin having the composition shown in Table 15 was lowered to 35° C. with sufficient stirring, and solutions 2-I and 2-II shown in Table 16 were concurrently added thereto for 1 minute. After an elapse of 1 minute, the temperature was elevated to 50° C. One minute after stabilization of the temperature, solutions 2-III and 2-IV shown in Table 16 were concurrently added for 24 minutes. After an elapse of 3 minutes, solutions 2-V and 2-VI shown in Table 16 were concurrently added for 40 minutes.

TABLE 15

COMPOSITION OF AQUEOUS SOLUTION OF GELATIN

| | |
|---|---|
| $H_2O$ | 1300 ml |
| Delimed Gelatin | 22 g |
| NaCl | 0.3 g |
| Grain Form Regulator | 439 mg |
| Temperature | 45° C. |

TABLE 16

| | Solution 2-I | Solution 2-II | Solution 2-III | Solution 2-IV |
|---|---|---|---|---|
| $AgNO_3$ | 5.7 g | | 18.3 g | |
| NaCl | | 2.10 g | | 4.54 g |
| Total Amount | Water to make 22 ml | Water to make 22 ml | Water to make 72 ml | Water to make 48 ml |

TABLE 16-continued

| | Solution 2-V | Solution 2-VI |
|---|---|---|
| $AgNO_3$ | 76 g | |
| NaCl | | 28.1 g |
| Total Amount | Water to make 298 ml | Water to make 298 ml |

Grain Form Regulator

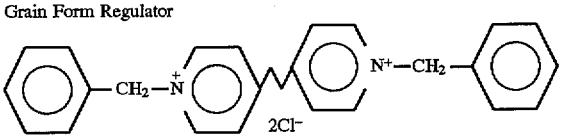

After conventional washing and salt removal (conducted at pH 4.1 using precipitant (a)), 22 g of delimed gelatin was added. After adjustment to pH 6.1 and pAg 7.1, chemical sensitization was conducted at 60° C. Compounds used in chemical sensitization were added in turn as shown in Table 17. Ten minutes after addition of sensitizing dye (a), chemical sensitization was terminated. The resulting emulsion was composed of hexagonal tabular grains comprising (111) faces having a diameter of a circle corresponding to a projected area of 1.1 μm and a thickness of 0.15 μm. The yield of this emulsion was 630 g.

TABLE 17

| Compound Used in Chemical Sensitization | Amount Added |
|---|---|
| Sodium Benzenethiosulfonate | 5.97 mg |
| Sodium Chloride | 1.27 g |
| Sodium Thiosulfate Pentahydrate | 1.94 mg |
| Decomposed Product of Ribonucleic Acid | 1.87 g |
| Chloroauric Acid | 3.36 mg |
| Preservative (a) | 70 mg |
| Preservative (b) | 3.13 g |
| KSCN | 0.2 g |
| Sensitizing Dye (a) | 0.50 g |

Preservative (b)

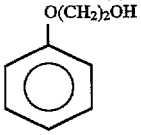

Preparation of Light-sensitive Silver Halide Emulsion 2-VI

Solutions 2-I and 2-II shown in Table 19 were concurrently added to an aqueous solution of gelatin having the composition shown in Table 18 with sufficient stirring for 15 seconds. After an elapse of 3 minutes, solutions 2-III and 2-IV shown in Table 19 were concurrently added for 21 seconds. After an elapse of 3 minutes, solutions 2-V and 2-VI shown in Table 19 were further concurrently added for 45 seconds. After an elapse of 5 minutes, an aqueous solution of gelatin shown in Table 20 was added, and immediately the temperature was elevated to 65° C. After an elapse of 7 minutes, solutions 2-VII and 2-VIII were concurrently added so as to give a silver potential (to SCE) of 120 mV, followed by physical ripening for 36 minutes.

TABLE 18

| COMPOSITION OF AQUEOUS SOLUTION OF GELATIN | |
|---|---|
| $H_2O$ | 750 ml |
| Delimed Gelatin | 9.4 g |

TABLE 18-continued

| COMPOSITION OF AQUEOUS SOLUTION OF GELATIN | |
|---|---|
| NaCl | 0.6 g |
| $HNO_3$ (1M) | 3.7 ml |
| Temperature | 40° C. |

TABLE 19

| | Solution 2-I | Solution 2-II | Solution 2-III | Solution 2-IV |
|---|---|---|---|---|
| $AgNO_3$ | 3.0 g | | 0.54 g | |
| NaCl | | 1.05 g | | |
| KBr | | | | 0.38 g |
| Total Amount | Water to make 7.5 ml | Water to make 7.5 ml | Water to make 13.5 ml | Water to make 13.5 ml |
| | Solution 2-V | Solution 2-VI | Solution 2-VII | Solution 2-VIII |
| $AgNO_3$ | 9 g | | 87.5 g | |
| NaCl | | 3.14 g | | 61.7 g |
| KBr | | | | |
| Total Amount | Water to make 22.5 ml | Water to make 22.5 ml | Water to make 175 ml | Water to make 350 ml |

TABLE 20

| | |
|---|---|
| $H_2O$ | 100 ml |
| Delimed Gelatin | 6.25 g |
| NaCl | 1.1 g |
| Sodium Hydroxide | 0.28 g |
| Dissolved at 40° C. | |

After conventional washing and salt removal (conducted at pH 4.1 using precipitant (b)), 22 g of delimed gelatin was added. After adjustment to pH 6.1 and pAg 7.1, chemical sensitization was conducted at 60° C. Compounds used in chemical sensitization were added in turn as shown in Table 21. Ten minutes after addition of sensitizing dye, chemical sensitization was terminated. The resulting emulsion was composed of orthorhombic tabular grains comprising (100) faces having a mean side length of 1.2 μm and a thickness of 0.12 μm. The yield of this emulsion was 630 g.

TABLE 21

| Compound Used in Chemical Sensitization | Amount Added |
|---|---|
| Sodium Ethylthiosulfonate | 6.50 mg |
| 4-Hydroxy-6-methyl-1,3,3a,7-tetraazaindene | 18 mg |
| Silver Bromide Emulsion (a) | 1 g |
| Chloroauric Acid | 0.40 mg |
| Sodium Thiosulfate Pentahydrate | 1.30 mg |
| Chemical Sensitizing Agent (a) | 1.03 mg |
| Preservative (a) | 70 mg |
| Preservative (b) | 3.13 g |
| Sensitizing Dye (a) | 0.55 g |

Precipitant (b)

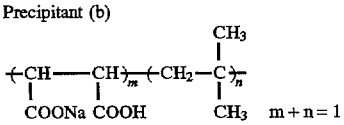

$m+n=1$

TABLE 21-continued

| Compound Used in Chemical Sensitization | Amount Added |
|---|---|

Chemical Sensitizing Agent (a)

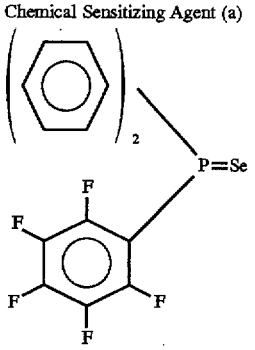

Silver bromide (a) shown in Table 21 is composed of grains having a grain size of 0.05 μm and has a silver content of 10%.

Preparation of Light-sensitive Silver Halide Emulsion 2-VII

Light-sensitive silver halide emulsion 2-VII was prepared in the same manner as with light-sensitive silver halide emulsion 2-I with the exception that compounds shown in Table 22 were added in turn, and that chemical sensitization was conducted at 60° C. and terminated 10 minutes after addition of sensitizing dye (a).

TABLE 22

| Compound Used in Chemical Sensitization | Amount Added |
|---|---|
| Chloroauric Acid | 9.70 mg |
| Antifoggant (a) | 6.5 mg |
| Sodium Thiosulfate Pentahydrate | 1.50 mg |
| KSeCN | 846 mg |
| Preservative (a) | 35 mg |
| 4-Hydroxy-6-methyl-1,3,3a,7-tetraazaindene | 88 mg |
| Sensitizing Dye (a) | 0.35 g |

Antifoggant (a)

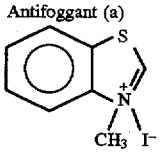

Then, in place of light-sensitive material 201, light-sensitive materials 205, 206 and 207 were prepared using light-sensitive silver halide emulsions 2-V, 2-VI and 2-VII, respectively, so as to give the same amount of silver coated. The light-sensitive materials obtained as described above were each processed together with complexing agent sheet R21 or R22 in the same manner as with Example 2-1 with the exception that exposure was carried out changing the quantity of light at a millionth of a second per picture element (100 $\mu m^2$) by use of a semiconductor laser having a peak at 680 nm. The sensitivity was evaluated by the reciprocal of an exposure giving a density of fog+0.1. Results thereof are shown in Table 23.

The results reveal that use of the complexing agent sheet containing the sulfite decreases the Dmin and decreases the Dmax, even for the light-sensitive materials containing the tabular grains low in Dmax and high in Dmin when used together with the blank complexing agent sheet. Further, the results show that the tabular grains are higher in sensitivity than the normal crystals.

TABLE 23

| Light-sensitive Material | Complexing Agent Sheet | Dmax | Dmin | Sensitivity |
|---|---|---|---|---|
| 201 | R21 (Invention) | 2.27 | 0.34 | 100 |
| 201 | R22 (Comparison) | 2.10 | 0.60 | 94 |
| 205 | R21 (Invention) | 2.42 | 0.27 | 253 |
| 205 | R22 (Comparison) | 1.95 | 0.74 | 211 |
| 206 | R21 (Invention) | 2.55 | 0.36 | 277 |
| 206 | R22 (Comparison) | 1.83 | 0.77 | 231 |
| 207 | R21 (Invention) | 2.21 | 0.41 | 181 |
| 207 | R22 (Comparison) | 2.07 | 0.82 | 167 |

While the invention has been described in detail and with reference to specific embodiments thereof, it will be apparent to one skilled in the art that various changes and modifications can be made therein without departing from the spirit and scope thereof.

What is claimed is:

1. An image formation method comprising (a) overlaying a silver halide light-sensitive material with a sheet after or during imagewise exposure, said light-sensitive material comprising a support having provided thereon at least a light-sensitive silver halide containing 90 mol % or more of silver chloride, a hydrophilic binder, a reducing agent and a slightly water-soluble basic metal compound, said sheet comprising a support having provided thereon at least a compound forming a complex with a metal ion constituting said basic metal compound, a physical development nucleus, and a compound represented by the following formula (I); and heat-developing the material in the presence of water to form a silver image on the light-sensitive material:

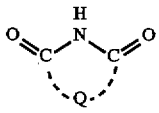

(I)

wherein Q represents an atomic group necessary to form a 5- or 6-membered imide ring; or (b) overlaying a silver halide light-sensitive material with a sheet after or during imagewise exposure, said light-sensitive material comprising a support having provided thereon at least a light-sensitive silver halide containing 80 mol % or more of silver chloride, a hydrophilic binder, a reducing agent and a slightly water-soluble basic metal compound, said sheet comprising a support having provided thereon at least a compound forming a complex with a metal ion constituting said basic metal compound, a physical development nucleus and a compound containing a sulfite ion; and heat-developing the material in the presence of water to form a silver image on the light-sensitive material.

2. The method as claimed in claim 1, wherein the sheet further comprises a polymer comprising at least one of a repeating unit represented by formula (II) and a repeating unit represented by formula (III):

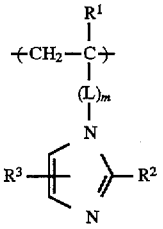

(II)

wherein $R^1$, $R^2$ and $R^3$ each represents a hydrogen atom or an alkyl group having 1 to 6 carbon atoms; L represents a divalent binding group having 1 to 20 carbon atoms; and m is 0 or 1;

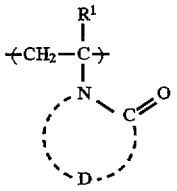

(III)

wherein $R^1$ represents an alkyl group having 1 to 6 carbon atoms; and D represents a divalent binding group necessary to form a 5-, 6- or 7-membered ring together with a nitrogen atom and a carbonyl group.

* * * * *